US007950551B2

(12) United States Patent
Thompson

(10) Patent No.: US 7,950,551 B2
(45) **Date of Patent: *May 31, 2011**

(54) SLING CLIP AND ATTACHMENT

(76) Inventor: Stephen T. Thompson, Cold Spring, MN (US)

( * ) Notice: Subject to any disclaimer, the term of this patent is extended or adjusted under 35 U.S.C. 154(b) by 1166 days.

This patent is subject to a terminal disclaimer.

(21) Appl. No.: 11/551,561

(22) Filed: Oct. 20, 2006

(65) Prior Publication Data

US 2007/0151999 A1 Jul. 5, 2007

Related U.S. Application Data

(63) Continuation-in-part of application No. 11/107,106, filed on Apr. 14, 2005, now abandoned.

(60) Provisional application No. 60/729,063, filed on Oct. 20, 2005, provisional application No. 60/562,904, filed on Apr. 16, 2004.

(51) Int. Cl.
*F41C 23/02* (2006.01)

(52) U.S. Cl. ..... 224/150; 224/913

(58) Field of Classification Search ..... 224/150, 224/913; 24/134 R, 134 KA, 134 KB, 134 L, 24/134 N, 134 P See application file for complete search history.

(56) References Cited

U.S. PATENT DOCUMENTS

| | | | | |
|---|---|---|---|---|
| 919,301 | A | | 4/1909 | Barron |
| 1,446,058 | A | | 2/1923 | Neilly |
| 1,853,313 | A | * | 4/1932 | Mathis ..... 24/134 P |
| 2,820,498 | A | | 1/1958 | Endee |
| 3,098,591 | A | | 7/1963 | Lerude |
| 3,655,106 | A | | 4/1972 | Wojcinski |
| 3,998,367 | A | | 12/1976 | Harding |
| 4,331,271 | A | | 5/1982 | Anderson |
| 4,613,067 | A | | 9/1986 | Gann |
| 5,050,786 | A | * | 9/1991 | DeMott ..... 224/666 |
| 5,146,655 | A | * | 9/1992 | Gibbs ..... 24/134 R |
| 5,353,538 | A | | 10/1994 | Hakedal et al. |

(Continued)

FOREIGN PATENT DOCUMENTS

DE 201 19 252 U1 5/2002

OTHER PUBLICATIONS

Jeff Cooper, The Art of the Rifle, 1997, pp. 34, 36, 40-45, 48-49, 62-69, Paladin Press, Boulder, CO.

*Primary Examiner* — Justin M Larson
(74) *Attorney, Agent, or Firm* — Albert W. Watkins

(57) ABSTRACT

A sling clip is disclosed that has a clamping mechanism capable of releasably securing the strap when the strap is slidably received through an opening in the sling clip. The sling clip also has an attachment mechanism configured to secure the sling clip proximate to a weapon bearer's body. The clamping mechanism is operatively configured to secure the strap within the sling clip when the weapon is in a firing position such that the strap minimizes movement of a muzzle end of the weapon caused by recoil of the weapon upon firing. A sling including the sling clip also is disclosed. The sling also includes a flexible strap having a first end and a second end is disclosed. The first end of the strap is configured to be secured to a weapon near a near a butt end of the weapon. The weapon may be a rifle, shotgun, or handgun as well as hand-held equipment such as a binocular or a camera.

12 Claims, 20 Drawing Sheets

U.S. PATENT DOCUMENTS

| | | | | |
|---|---|---|---|---|
| 5,615,811 | A | 4/1997 | Bell et al. | |
| 5,715,979 | A | 2/1998 | Crandall | |
| 5,738,256 | A | 4/1998 | Goff et al. | |
| 5,810,219 | A | 9/1998 | Rosenfield | |
| 5,988,466 | A | 11/1999 | Brown | |
| 6,119,907 | A | 9/2000 | Benjamin | |
| RE37,111 | E | 3/2001 | Barron | |
| 6,260,748 | B1 | 7/2001 | Lindsey | |
| 6,279,795 | B1 | 8/2001 | Pierzina | |
| 6,574,838 | B2 | 6/2003 | Maurer | |
| 6,672,492 | B1 | 1/2004 | Thompson | |
| 7,039,987 | B2 * | 5/2006 | van Gijsel et al. | 24/134 R |
| 2002/0148866 | A1 | 10/2002 | Dent, III | |
| 2003/0234266 | A1 | 12/2003 | Thompson | |

* cited by examiner

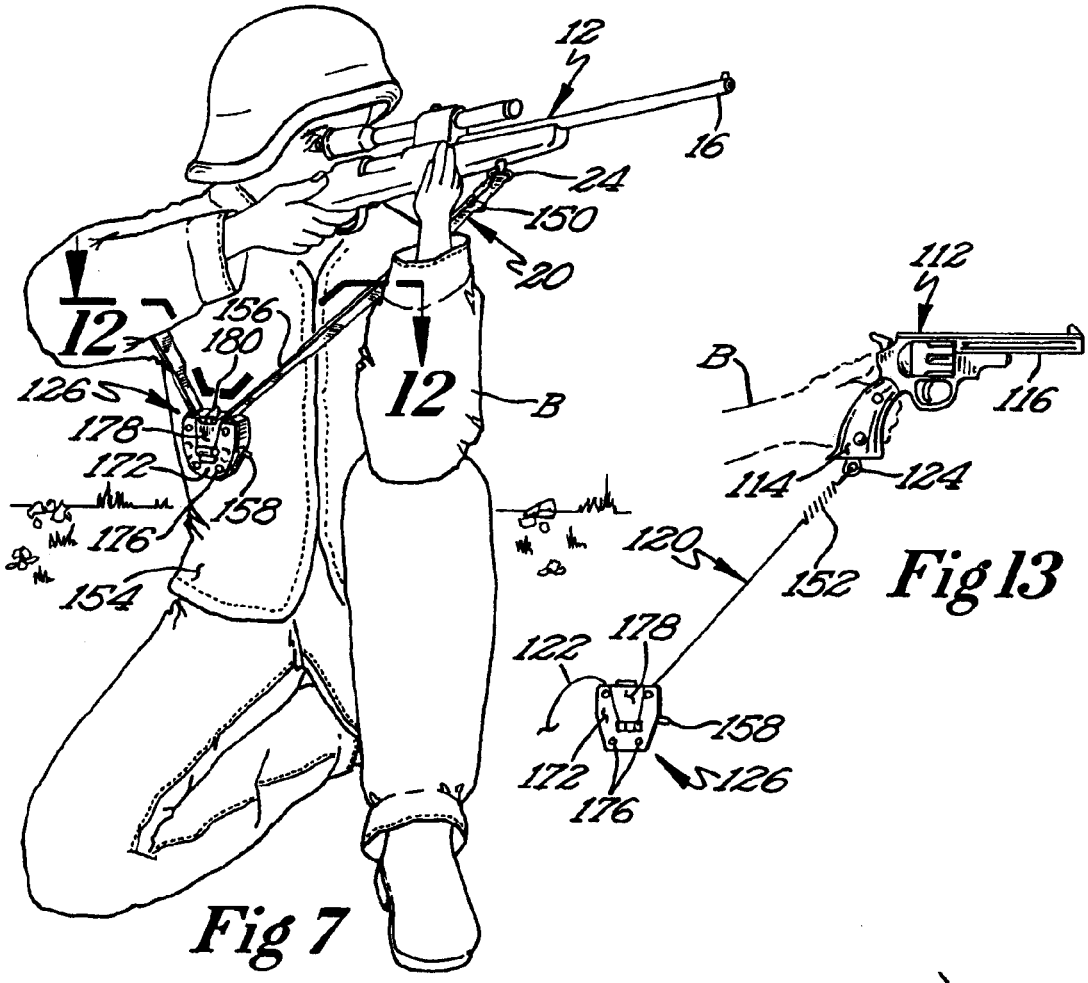
Fig 13
Fig 7
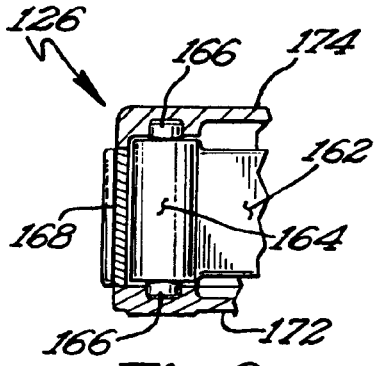
Fig 9
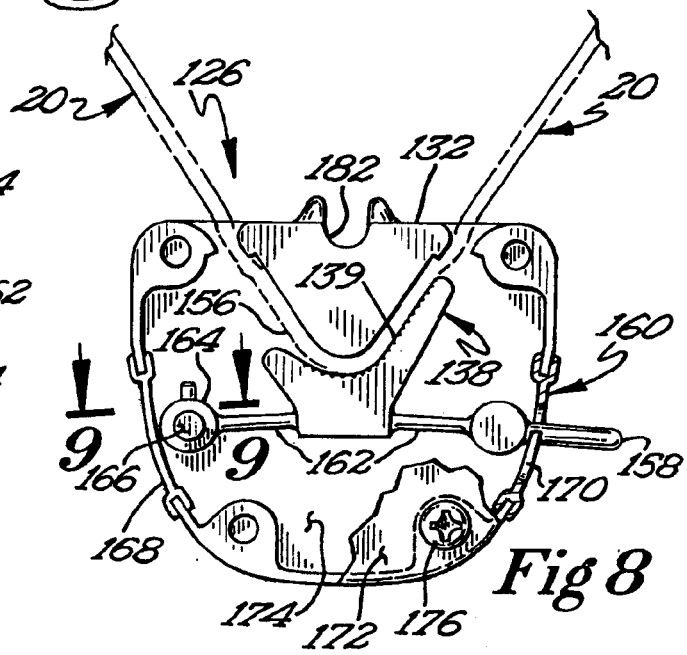
Fig 8

SLING CLIP AND ATTACHMENT

RELATED APPLICATIONS

This application claims the benefit of U.S. Provisional Application No. 60/729,063 filed Oct. 20, 2005, entitled "Sling Clip and Weapon Sling."

This application is a continuation-in-part of U.S. patent application Ser. No. 11/107,106, filed Apr. 15, 2005, now abandoned, entitled "Sling Clip and Weapon Sling", which claims the benefit of U.S. Provisional Application No. 60/562,904, filed Apr. 16, 2004, entitled "Rifle and Handgun Sling."

TECHNICAL BACKGROUND

The disclosure relates to a sling for stabilizing weapons and other hand-held equipment during use and for transporting the same. More specifically, the disclosure relates to a sling that couples the weapon or equipment to the user's body to effect stabilization of the weapon or equipment.

BACKGROUND

Slings and straps and the like are commonly used for transporting and stabilizing weapons and other hand-held equipment such as rifles, shotguns, handguns, bows, crossbows, binoculars, telescopes, and still and motion picture cameras. As used herein, the term weapon is intended to include rifles, shotguns, handguns, bows, crossbows and other weapons as well as hand-held equipment such as binoculars, telescopes, cameras and the like.

One problem common to slings designed to facilitate the transportation of weapons is that there is little thought given to whether or how these slings may be used to stabilize the weapon during firing. One example is U.S. Pat. No. 3,098,591 to Lerude. Lerude's harness is adapted for carrying a rifle in a slung position but teaches nothing with regard to the stabilization of the weapon during firing. U.S. Pat. No. 4,613,067 to Gann discloses a carrying sling that permits a weapon to be transported in a variety of positions but discloses no manner in which the carrying sling may be used to stabilize the gun during firing.

Other slings attempt to navigate the middle ground between ease of transportation and stabilization of the weapon for firing. Examples of such patents include U.S. Pat. No. 4,331,271 to Anderson and U.S. Pat. No. 6,260,748 to Lindsey. Anderson discloses a sling for shoulder guns in which a shoulder gun is supported in a slung position from a belt to which is attached a strap. Pains are taken to insure that the shoulder gun will maintain its slung position during transport. However, for stabilization, Anderson relies on the well-known technique of wrapping the sling strap about the elbow of the arm with which the user of the weapon grasps the forearm of the stock. In this way, the user of the weapon is able to achieve a more secure connection between his or her arm and the weapon. However, this method of stabilizing a weapon for firing relies on the stability of the user's arms, an inherently unstable member of the human body. Accordingly, the Anderson sling is not capable of providing much in the way of stabilization for a weapon being fired.

The Lindsey sling is adapted for supporting a weapon across the front of the user's chest. A strap may be included between the muzzle end of the weapon and the shoulder of the user and by tensioning this strap between the shoulder and the muzzle end of the weapon the weapon may be stabilized to some degree. Not only is Lindsey's sling relatively limited insofar as it offers only two carrying positions for the weapon, but it provides no dissipation of the phenomenon of muzzle flip as the anchoring point for the stabilizing strap is positioned above the muzzle end of the weapon when the weapon is fired.

Other prior art designs have all but abandoned the goal of supporting a weapon for transport in favor of providing a maximum amount of stability for the weapon during firing. U.S. Pat. No. 5,738,256 to Goff et al. discloses an adaptable aiming support that essentially comprises a belt that has a rigid support with a fork at its upper end attached thereto. In use, the fork at the end of the rigid support is placed beneath the forearm or muzzle end of the weapon being fired when the weapon is in its firing position. The Goff et al. aiming support does offer better stability to the weapon during firing but is incapable of use as a traditional sling in that it is not able to support a weapon during transport at all.

U.S. Pat. No. 5,988,466 to Brown is a variation upon the adaptable aiming support of Goff et al. in that the tubular support member upon which a weapon is supported is permanently affixed to the weapon and is constructed and arranged to have a greater degree of rotation, thereby allowing the gun to be moved from a firing position to a carrying position in which the muzzle of the gun points upwardly. However, the weapon remains coupled to the tubular support member and may not be transported apart from the support without first uncoupling the weapon from the support. But in doing so, the weapon will have to be re-coupled to the support for use in the intended manner.

U.S. Pat. No. 6,112,448 to Gray et al. discloses a forearm sling that attempts to improve the stability of a weapon during firing by coupling the weapon to the forearm of the user. Again, while coupling a weapon to the arm of a user can increase the stability of the weapon during firing to some degree, the arm of a user is inherently unstable and cannot adequately stabilize a weapon during firing. What is more, the Gray et al. forearm sling has no way of counteracting the incidence of muzzle flip engendered by the firing of the weapon and does not provide a means for transporting the weapon.

Accordingly, there is a recognized need for a sling for use with weapons of various types and with other types of hand-held equipment that can facilitate the transport of the weapon in a variety of slung positions, in the crook of an arm, or in the hands, that does not involve the need to disassemble the sling. There is also a need for a sling that can couple a weapon to the user's body (e.g., proximate, the chest, the back, the hips or other truncal portion of a user's body) to sufficiently stabilize the weapon for firing. Such a sling should be usable in multiple shooting/use positions.

SUMMARY OF THE DISCLOSURE

A sling clip is disclosed that has a clamping mechanism capable of releasably securing the strap when the strap is slidably received through an opening in the sling clip. The sling clip also has an attachment mechanism configured to secure the sling clip proximate to a weapon user's body. The clamping mechanism is operatively configured to secure the strap within the sling clip when the weapon is in a firing position such that the strap minimizes movement of a muzzle end of the weapon caused by recoil of the weapon upon firing. A weapon sling including the sling clip also is disclosed. The weapon sling also includes a flexible strap having a first end and a second end is disclosed. The first end of the strap is configured to be secured to a weapon near a near a butt end of the weapon. The weapon may be a rifle, shotgun, or handgun as well as hand-held equipment such as a binocular or a camera.

Additional objects, advantages, and features will become apparent from the following description and the claims that follow, considered in conjunction with the accompanying drawings.

BRIEF DESCRIPTION OF THE DRAWINGS

FIG. 7 illustrates a user of a rifle having another embodiment of a sling coupled thereto with the user holding the rifle in a kneeling firing position.

FIG. 8 illustrates still another embodiment comprising a sling clip having a clamping mechanism.

FIG. 9 is a close-up view of the bearing assembly taken along a cute line of the clamping mechanism shown in FIG. 8.

FIG. 13 illustrates yet another alternative embodiment weapon sling with a sling clip attached at a single point to a handgun.

DESCRIPTION OF VARIOUS EMBODIMENTS

Figures 1, 4, 5, 6:
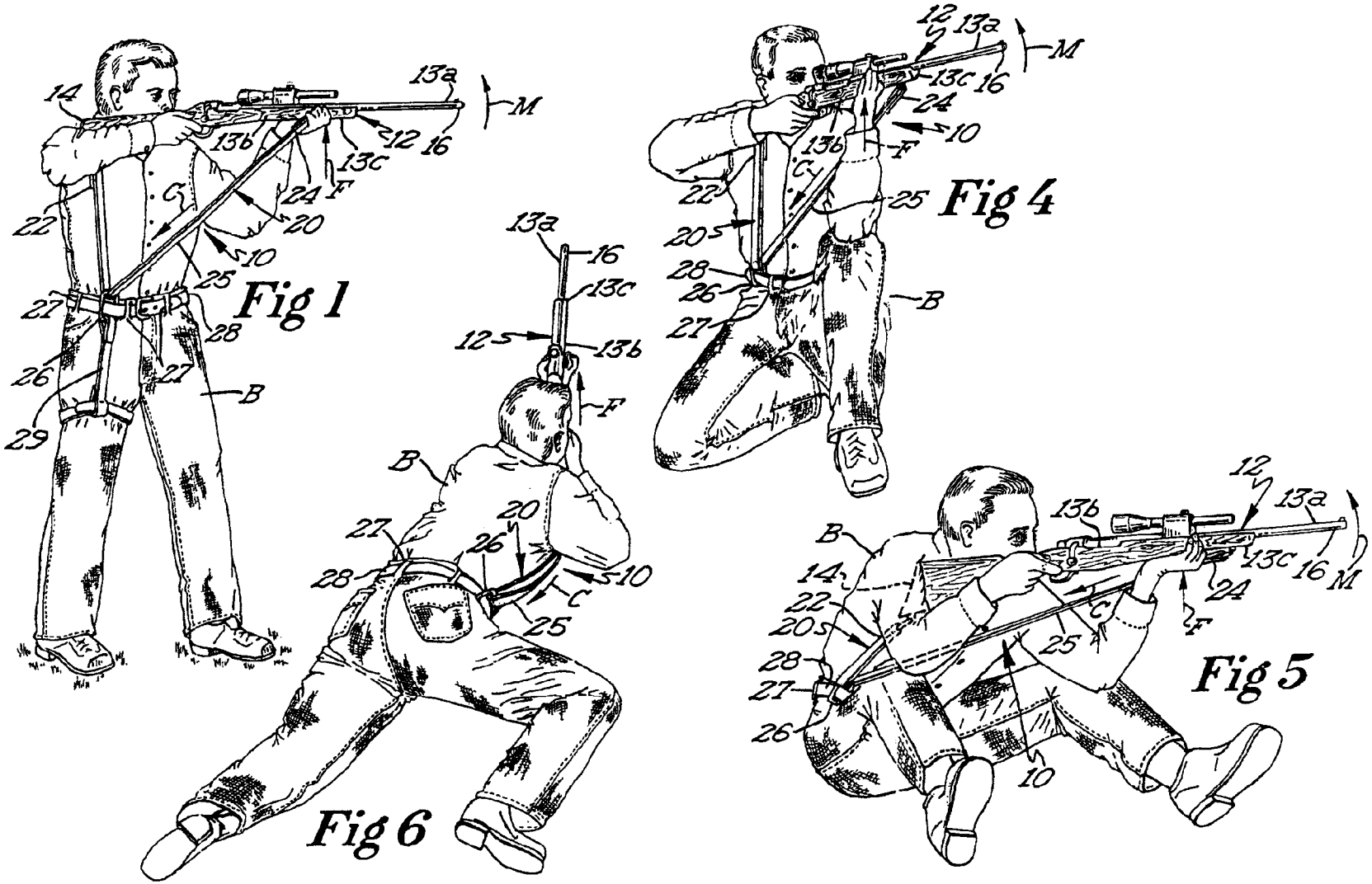
FIG. 1 illustrates a user of a rifle holding the weapon in a standing, offhand firing position with an embodiment of the rifle sling being deployed in its firing position.
FIG. 4 illustrates a user of a rifle having a sling coupled thereto with the user holding the rifle in a kneeling firing position.
FIG. 5 illustrates a user of a rifle having a sling coupled thereto with the user holding the rifle in an open-legged sitting firing position.
FIG. 6 illustrates a user of a rifle having a sling coupled thereto with the user holding the rifle in the Olympic prone firing position.

According to various embodiments, a sling arrangement may provide improved stability for a weapon, such as a typical rifle or shotgun, or other device that would benefit from accurate orientation, such as a camera or binoculars. Certain embodiments are described as being used with a weapon; however, it will be appreciated by those having ordinary skill in the art that the principles described herein may be more broadly applicable to other types of devices. When the sling arrangement is employed in connection with a rifle, the rifle has a barrel mounted in a stock with a butt end arranged to be positioned against the shoulder of a user when the rifle is in a firing position and a forearm portion positioned adjacent a muzzle end of the barrel, with the muzzle end of the rifle being supported at the forearm portion of the stock by the user when the rifle is in its firing position. The rifle is steadied in its firing position by a sling that comprises a flexible strap that has a first end and a second end. The first end of the strap is rotatively attached to the rifle adjacent its butt end, the second end of the strap being similarly attached to the rifle at the forearm portion of the stock of the rifle adjacent the muzzle end of the barrel of the rifle. Typically, the strap of the sling is attached to the rifle using standard, well-known devices such as a simple D-ring screwed to the stock of the rifle or a hammerhead sling socket. The strap also has an intermediate portion that is coupled proximate to a body portion of the user of the rifle (e.g., waist, side, chest, or back).

When the rifle is in its firing position with the butt end of the rifle positioned against the user's shoulder, the strap of the sling extends downward to the user's waist and from there to the forearm portion of the stock of the rifle, thereby creating a relatively rigid coupling between the waist or torso of the user of the rifle. This coupling between the muzzle end of the rifle and the waist of the user prevents recoil forces engendered in the rifle as a result of firing the rifle from causing to the muzzle end of the rifle to rise. This rise, called muzzle flip, can negatively affect the aim of the user and result in inaccurate and imprecise shooting. Rapid fire weapons, such as squad automatic weapons (SAWs), exhibit a particularly strong tendency for muzzle rise.

A feature of an embodiment of the sling is that the strap of the sling is also capable of supporting the rifle in a carrying position in which the rifle is positioned on the back of the user for transport.

The strap of the sling may be coupled to the waist or torso of the user of the rifle in many ways. In some embodiments, the sling strap 20 is simply passed through the belt 28 or a belt loop 27 of the user. Because the butt end of the rifle stock is firmly anchored to the shoulder area of the torso, the fixed length of the strap effectively couples the muzzle end of the rifle to the waist of the user so as to prevent or at least reduce muzzle flip.

Figures 2, 3:
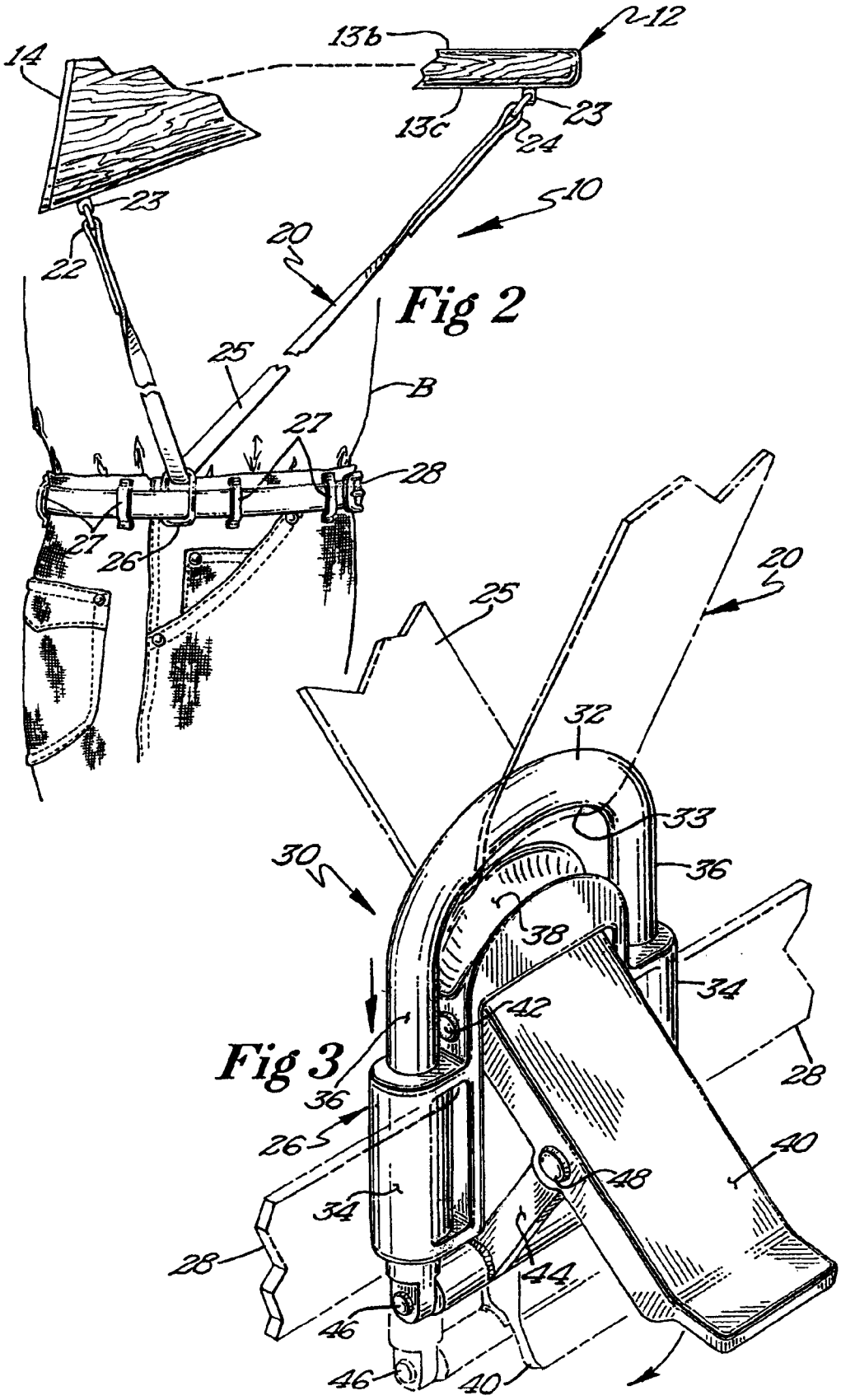
FIG. 2 is a close-up of an embodiment comprising a simple carabiner coupled to a belt passed around the waist of the user.
FIG. 3 is a close-up of an embodiment comprising a sling clip having a clamping mechanism.

In another embodiment as shown in FIG. 2, the strap 20 of the rifle sling 10 is coupled to the waist of the user using a simple carabiner type mechanism 26 that is itself coupled to the belt 28 or belt loop 27 of the user. Use of the carabiner allows the sling strap to be easily detached from the waist of the user. Alternatively, the user may couple the sling strap to his or her waist using a more complex harness that attaches to the waist and/or at least one leg of the user.

Where desirable, the sling strap may be constrained with respect to the user's waist and to the carabiner type structure used to couple the sling strap thereto. A simple way of accomplishing this is to secure a stop to the sling strap so as to control the movement of the sling strap through the carabiner or loop that couples the sling strap to the user's waist. The stop creates a relatively rigid connection of predetermined length between the muzzle end of the rifle and the waist of the user by limiting the travel of the sling strap through the carabiner or ring coupled to the waist of the user. In another embodiment, a sling clip is coupled to the waist of the user and is constructed and arranged to releasably grip the strap of the sling when the rifle is in its firing position. Once the rifle is in its firing position, the sling clip grasps the strap and securely couples the muzzle end of the rifle to the waist of the user to prevent or limit muzzle flip.

In some embodiments, the sling strap is substantially non-elastic or has an elasticity that is relatively low. Good examples of suitable materials from which the sling strap may be fashioned include webbing of nylon and other synthetic materials such as Kevlar, polyvinyl chloride, and the like and natural materials such as leather. In other embodiments, however, the sling strap is substantially elastic or has a relatively high elasticity, or includes a relatively elastic section. Such embodiments may benefit from improved shock absorption, as well as a reduced need to adjust the length of the sling strap for different applications or users.

In certain embodiments of the sling, the flexible strap and the sling clip permit the user of the rifle to carry the rifle in the port arms position, cradled in the crook of the user's right or left arm, cantilevered over the user's right or left forearm with the stock of the rifle being wedged under the user's respective arm, to be slung over the shoulder of the user, to be slung across the user's back, and to be carried in the hand of the user with the user's arm extended, respectively. Similarly, the rifle may be fired from a group of firing positions including, but not limited to, a prone position, a sitting position, a squatting position, an offhand position, a standing position, a kneeling position, and a rest position in which the rifle is supported, at least in part, by an object other than the user of the rifle. The rifle may be freely moved between the transport or carrying positions and the firing position with ease and without requiring the sling strap to be uncoupled from the hips of the user.

FIG. 1 illustrates a rifle sling 10 according to one embodiment as it is employed with a firearm, such as a rifle 12. The rifle 12 is of a known configuration, having a tubular barrel 13*a* mounted on a stock 13*b*. The stock 13*b* has a forward portion known as the forearm 13*c* that is generally positioned under the barrel 13*a* of the rifle 12 near a muzzle end 16 of the rifle. The forearm 13*c* of the rifle 12 may be separated from the remainder of the stock 13*b* or may be formed integrally therewith. As can be seen, the bearer B of the rifle 12 has placed the rifle 12 in a firing position in which a butt end 14 of the rifle 12 is seated firmly into the shoulder of the bearer B with the rifle 12 held generally horizontal and supported by the bearer B at the forearm 13*c* near the muzzle end 16 of the rifle 12.

The sling 10 includes a strap 20 that is secured at a first end portion 22 near the butt end 14 of the rifle 12 and at a second end portion 24 near the muzzle end 16 of the rifle 12. See FIG. 2. Note that the exact manner in which the respective end portions 22, 24 of the strap 20 are secured to the rifle 12 may vary. For example, the strap 20 may be secured at its end portions 22, 24 to the rifle 12 by means of a swivel 23 of a type commonly known to the prior art for attaching rifle slings to a rifle 12. The strap 20 is fashioned of a flexible material such as leather or nylon webbing and may also include an adjustment mechanism for modifying the length of the strap (not shown). Such adjustment mechanisms are commonly known in the prior art.

The strap 20, along with any adjustment mechanisms and the mechanisms whereby the strap end portions 22, 24 are secured to the rifle 12 may be either inelastic or elastic. Flexibility of the strap 20 facilitates firing and transporting the rifle 12. An inelastic strap 20 maintains substantially the same length at all times after its initial configuration. While it is appreciated that the certain materials from which the strap may be made, such as leather and nylon webbing, do incorporate some degree of flexibility, this inherent flexibility would not substantially affect the overall elasticity of the strap 20. Reducing the flexibility of the strap 20 facilitates maintaining substantially the same length at all times after initial configuration of the strap 20. In applications in which this characteristic is desirable, it may be preferable to utilize a substantially inelastic material such as Kevlar™, carbon fiber composites, or the like. In other embodiments, the strap 20 is made of a relatively elastic material. Such embodiments may benefit from improved shock absorption, as well as a reduced need to adjust the length of the sling strap for different applications or users. In still other embodiments, the strap 20 may include portions that are relatively inelastic and other portions that are relatively elastic.

A portion 25 of the strap 20 intermediate the end portions 22, 24 is passed through a sling clip 26. The sling clip is in turn coupled to the waist or truncal portions of the bearer B. In the embodiment illustrated in FIG. 1, when a rifle 12 is to be fired, the butt end 14 of the rifle will be firmly pressed into the shoulder of the bearer B. The placement of the butt end 14 of the rifle 12 in the shoulder essentially fixes the position of the first end 22 of the strap 20 with regard to the waist and truncal portions of the bearer B. The intermediate portion 25 of the strap 20 is similarly anchored to the waist and truncal portions of the bearer's body by means of the sling clip 26. The sling clip 26 may be as simple as a belt loop 27 on the bearer's B trousers or a carabiner of the type commonly used by climbers. More complex sling clips 26 may also be used. Note that the sling clip 26 may be coupled to the bearer's waist by means of a belt loop 27 or a belt 28. The belt 28 may be used on its own or may be combined with or may form part of a harness 29. In some embodiments, the harness 29 further couples the sling clip 26 to the legs of the bearer B similar to the manner in which a typical climbing harness is secured to both the waist and legs of a climber.

The secure placement of the butt end 14 of the rifle 12 into the shoulder of the bearer B, along with the secure coupling of the intermediate portion 25 of the strap 20 to the waist of the bearer B effectively couples the muzzle end 16 of the rifle 12 to the waist and truncal portions of the bearer B. The application of a light to moderate upward force against the forearm 13*c* of the rifle by the forward hand of the bearer B, indicated by arrow F, serves to complete the coupling of the muzzle 16 of the rifle 12 to the truncal portions of the bearer B by creating a relatively rigid structural member having a triangular shape with apexes at the first and second end portions 22, 24 of the strap 20 and at the intermediate portion 25 of the strap 20 where it passes through the sling clip 26.

When the rifle 12 is fired, the recoil engendered by the firing tends to create a moment indicated by arrow M that is commonly referred to as muzzle flip. In rifles, shotguns, or other weapons constructed and arranged for a high rate of fire such as with semi-automatic and fully automatic weapons, the additive effect of multiple applications of the moment M can result in severe accuracy problems in that the muzzle end 16 of the rifle 12 will be jerked out of alignment with an intended target (not shown). The sling 10 of FIG. 1 counteracts the moment M by applying a counteracting corrective force indicated by arrow C to the muzzle end 16 of the rifle 12 through the second end 24 of the strap 20. Because the rifle 12, the truncal portion of the bearer's body between the shoulder and the waist, and the strap 20 maintain essentially the same dimensions at all times during the firing of the rifle 12, the moment M engendered by the recoil in the rifle 12 will be counteracted by a tension in the strap 20 indicated by arrow C. Note that the rifle 12 may be fired in many different positions while using the sling 10. By way of example and not limitation, a rifle 12 incorporating the sling 10 may be fired from an offhand standing position as seen in FIG. 1, from a kneeling position as seen in FIG. 4, from an open-legged position as seen in FIG. 5, and from the Olympic prone position as seen in FIG. 6. Note that sling 10 may be employed from virtually any firing position, including, but not limited to, standing positions, sitting positions, prone positions, kneeling positions, and bench rest positions.

Because the intermediate portion 25 of the strap 20 may freely pass through the sling clip 26 illustrated in FIG. 1, it is relatively simple to move the rifle 12 from its firing position illustrated in FIG. 1 to a slung position (not shown) in which the rifle is positioned over the right shoulder with the muzzle end 16 of the rifle 12 pointing upwards over the bearer's shoulder; the strap 20 passes over the shoulder to support the rifle 12. The rifle 12 may also be transported slung diagonally across the bearer's back, in the hand with the carrying arm extended, cradled in the crook of the bearer's right or left arm with the muzzle end 16 of the rifle 12 pointing upward, in a port arms or ready position, or cantilevered over the right or left forearm of the bearer B with the butt end 14 of the rifle 12 wedged beneath the corresponding right or left arm. Each of these transport positions for the rifle 12 may be achieved without first uncoupling the strap 20 from the waist and truncal regions of the bearer B.

FIG. 3 illustrates an embodiment including a sling clip 26 that incorporates a clamping or locking mechanism 30. The sling clip 26 comprises a U-shaped ring 32 and a sliding block 34 received onto parallel legs 36 of the ring 32. The sliding block 34 slides on the legs 36 between the open position shown in FIG. 3 and a closed position. In the closed position, an upper, curved portion 38 of the sliding block engages a bottom portion 33 of the ring 32 and consequently clamps the strap 20 therebetween and controls the movement of the strap 20 through the sling clip 26. In FIG. 3, the strap 20 of the sling 10 is shown in phantom. The sliding block 34 is actuated between its open and closed positions by the locking mechanism 30.

The locking mechanism 30 comprises an over-center lever mechanism having a lever arm 40 that is rotatively pinned to the sliding block by a pin 42. One or more fulcrum arms 44 are rotatively pinned to the distal ends of legs 36 of by a pin 46. The fulcrum arms 44 are rotatively pinned at their opposing ends to an intermediate portion of the lever arm 40 by pins 48. When the lever arm 40 is moved from its open position to its closed position as shown in phantom in FIG. 3, the pinned end of the lever arm acts in conjunction with the fulcrum arms 44 to move the sliding block 34 to its closed position (not shown). The locking mechanism 30 may be operated by the bearer B by simply pressing down the lever arm 40 with the trigger hand when the rifle 12 is in its desired firing position. Preferably, the locking mechanism 30 will be constructed and arranged to remain in its closed position until such time as the bearer B physically opens or actuates the lever arm 40. This is easily accomplished by forming the lever arm 40 and the fulcrum arms 44 in an over-center arrangement. The sling clip 26 may be coupled to the hips of the bearer 26 by providing an attachment mechanism that may be coupled to a belt 28 or harness 29 that are themselves coupled to the bearer B.

FIGS. 7 through 12 illustrate a bearer of a rifle having an alternative embodiment sling that is similar to the preferred embodiment depicted in FIGS. 1 through 6. In this alternative embodiment, as more clearly shown in FIG. 7, a bearer B of a rifle or other weapon has an alternative embodiment sling clip 126 coupled proximate to a side or chest portion of the bearer's body B. It will be appreciated by those skilled in the art that the sling clip 126 could be attached to various parts of the bearer's body without departing from the scope and spirit of the present invention (e.g., proximate a thigh, arm, back, chest, side, or waist portion of the body). The spring clip 126 can be securely attached by any of a variety of attachment mechanisms (not shown) such as a bolt, rivet, screw, button hole, leather loop, or the like that to clothing or body armor 154 on the bearer B so that the spring clip 126 is secured proximate to the weapon bearer's body B. The bearer B is holding the rifle 12 in a kneeling firing position.

The second end 24 of the strap 20 shown in FIG. 7 also has an elastic member 150 located near the muzzle end 16 of the rifle 12. This elastic member 150 helps to dampen vertical movement of the muzzle end 16 caused by recoil motion of the rifle when the rifle is fired. This dampening action of the elastic member 150 is especially helpful on semi-automatic firearms that may have recoil motion when fired in rapid succession by supplementing the counteracting corrective force indicated by arrow C that is already being applied by sling 10. The elastic member 150 may be an elastic strap, rubberized link, a metal or plastic spring or any other device that tends to dampen movement of elements that are attached to opposite ends of the elastic member.

Figure 11:
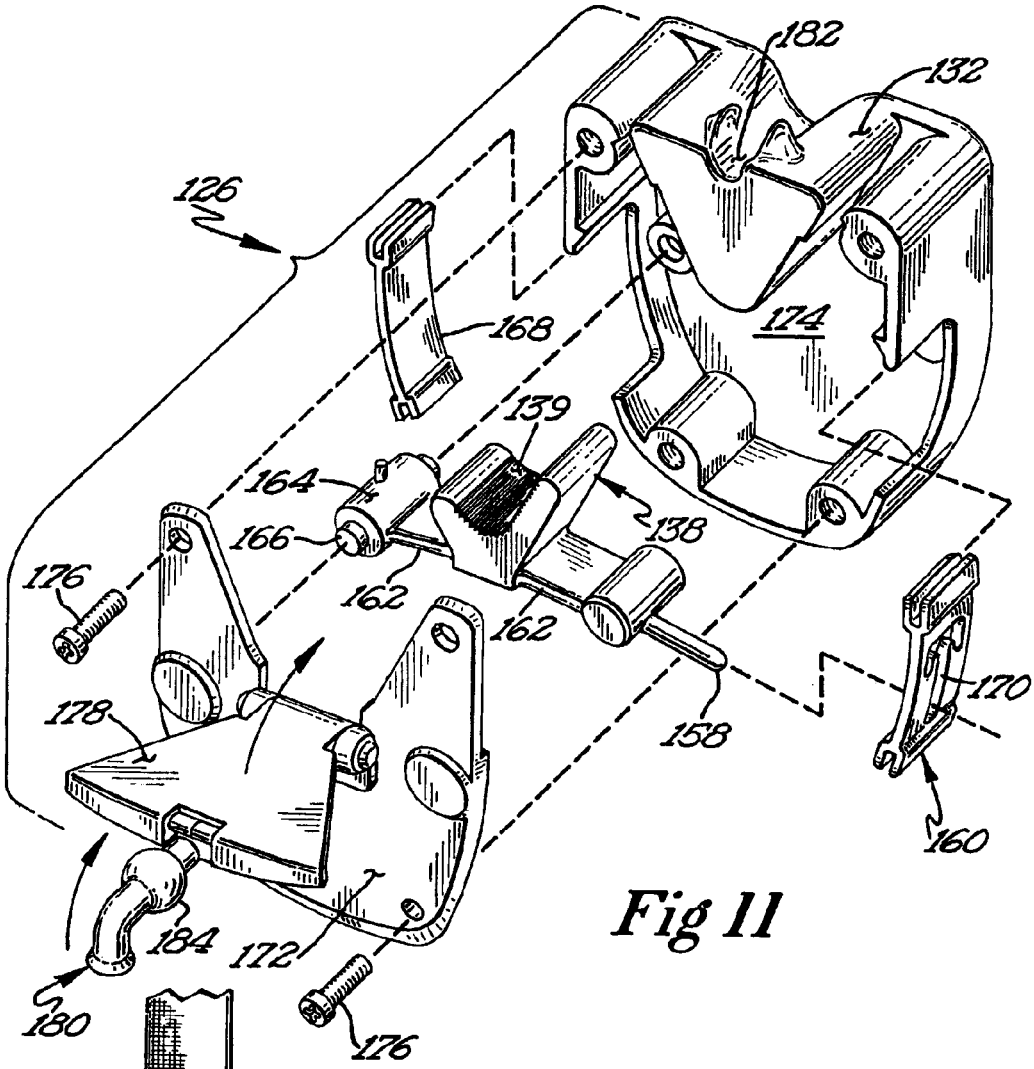
FIG. 11 is a close-up exploded view of the alternative embodiment sling clip shown in FIG. 8.

FIGS. 8 and 11 illustrate the alternative embodiment sling clip 126 and associated clamping mechanism formed by a U-shaped upper member 132 and a curved lower member 138. The sling clip 126 has a lever knob 158 that is movable in a T slot 160 between a locked up position and a released down position. The lever knob 158 is connected to the curved lower member 138. The curved lower member 138 pivots from a pivot portion 164 about a pivot point in response to movements of the lever knob 158. FIG. 8 shows lever knob 158 in the locked position where the strap 20 is clamped into position and prevented from freely sliding between the U-shaped upper member 132 and the curved lower member 138. The curved lower member 138 may include a straight knurled portion 139 that can more readily frictionally grip strap 20 when the curved lower member 138 is pressed next to the upper member 132 in the locked position. The front wall 172 is secured to the rear wall by a screw 176 to form the main body of the sling clip 126. The sling clip 126 also includes a front door portion 178 with a hinge adjacent to the clamping mechanism formed by the members 132 and 138. This front door portion 178 is engaged with front wall 172 through the hinge. When in the open position, the strap 20 can be inserted through the front door portion 178 into the slot formed between the U-shaped upper member 132 and the curved lower member 138. The use of this front door portion 178 allows the strap 20 to be inserted into the sling clip 126 without the need for removing the sling clip 126 from its secured position proximate to the weapon bearer's body B. In addition, the use of this front door portion 178 allows the strap 20 to remain secured to the weapon 12 while being inserted into the sling clip 126. The front door portion 178 can be secured to the rear wall 174 in the closed position by a flexible flanged rope 180 by moving the flanged portion 184 into slotted section 182 of the rear wall 174.

FIG. 9 is a close-up view of the bearing assembly taken along a section line 9-9 of the clamping mechanism formed by the members 132 and 138 shown in FIG. 8. Lever 162 has a pivot portion 164 with bearing points 166 formed thereon. The bearing points engage the front 172 and rear 174 walls of sling clip 126 to provide a pivot point for the lever 162. The walls 172, 174 are spaced apart from one another by a blank side plate 168 and a T slot side plate 170.

Figure 10:
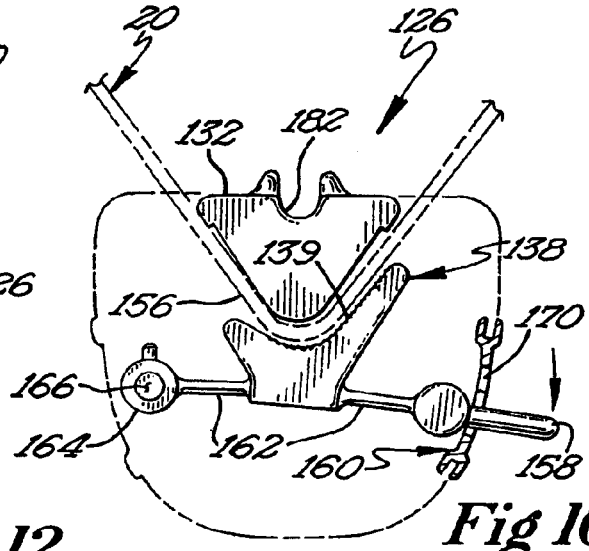
FIG. 10 is a close-up of the alternative embodiment clamping mechanism with the remaining portions of the sling clip shown in FIG. 8 being shown in phantom lines.

FIG. 10 is a close-up of the alternative embodiment clamping mechanism formed by the members 132 and 138 in an open or released position with the remaining portions of the sling clip 126 shown in FIG. 8 being shown in phantom lines. The lever knob 158 has been moved downward in the T slot 160 so than strap 20 can freely slide between the U-shared upper member 132 and curved lower member 138.

Figure 12:
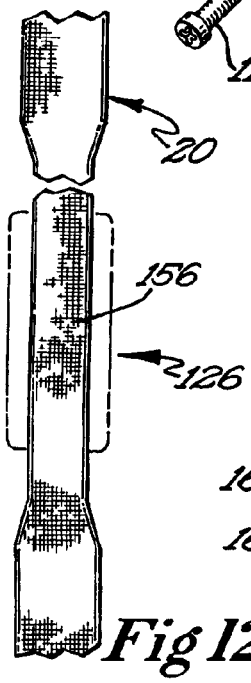
FIG. 12 is a close-up view of an alternative embodiment sling taken along a cut line of the sling shown in FIG. 7.

FIG. 12 is a close-up view of an alternative embodiment strap 20 having a tapered portion 156 taken along a cut line 12 of the sling 10 shown in FIG. 7. The tapered portion 156 may be added to a strap 20 so that spring clip 126 can be formed with a narrower depth than one would have to be formed to accommodate a wider strap. A wider strap 20 may be desirable especially on the strap portion that would typically fall on a bearer's shoulder. The wider strap portion in the shoulder region would spread the weapon weight over a larger body surface and thus alleviate undue pressure on the bearer's shoulder. At the same time, it is desirable to minimize the size of the spring clip 126 so that weight of the spring clip 126 can be minimized. A reasonable compromise of these competing desires is to form a tapered portion 156 of the strap 20 near the spring clip 126 and perhaps provide a wider portion of the strap near the shoulder. Alternatively, a shoulder pad could be added to the strap 20 near the shoulder where the bearer would have the strap located when carrying the rifle 12 or other weapon.

FIG. 13 illustrates another weapon sling 120 or lanyard with the sling clip 126 attached at a single point 124 to a handgun 112 that is held by a bearer B, according to another embodiment. In this embodiment, the strap 120 has one end 124 coupled to a butt end 114 of the handgun 112. The strap 120 passes through spring clip 126 and operating is substantially the same way to provide a counteracting corrective force C as previously described in reference to strap 20. The strap also includes a self-recoiling spring 152 or other dampening device like elastic member 150 shown in FIG. 7. In this alternative embodiment, the other end 122 of the strap 120 may be left unattached to the bearer's clothing or may for convenience be loosely dangled from the spring clip 126.

Figure 14:
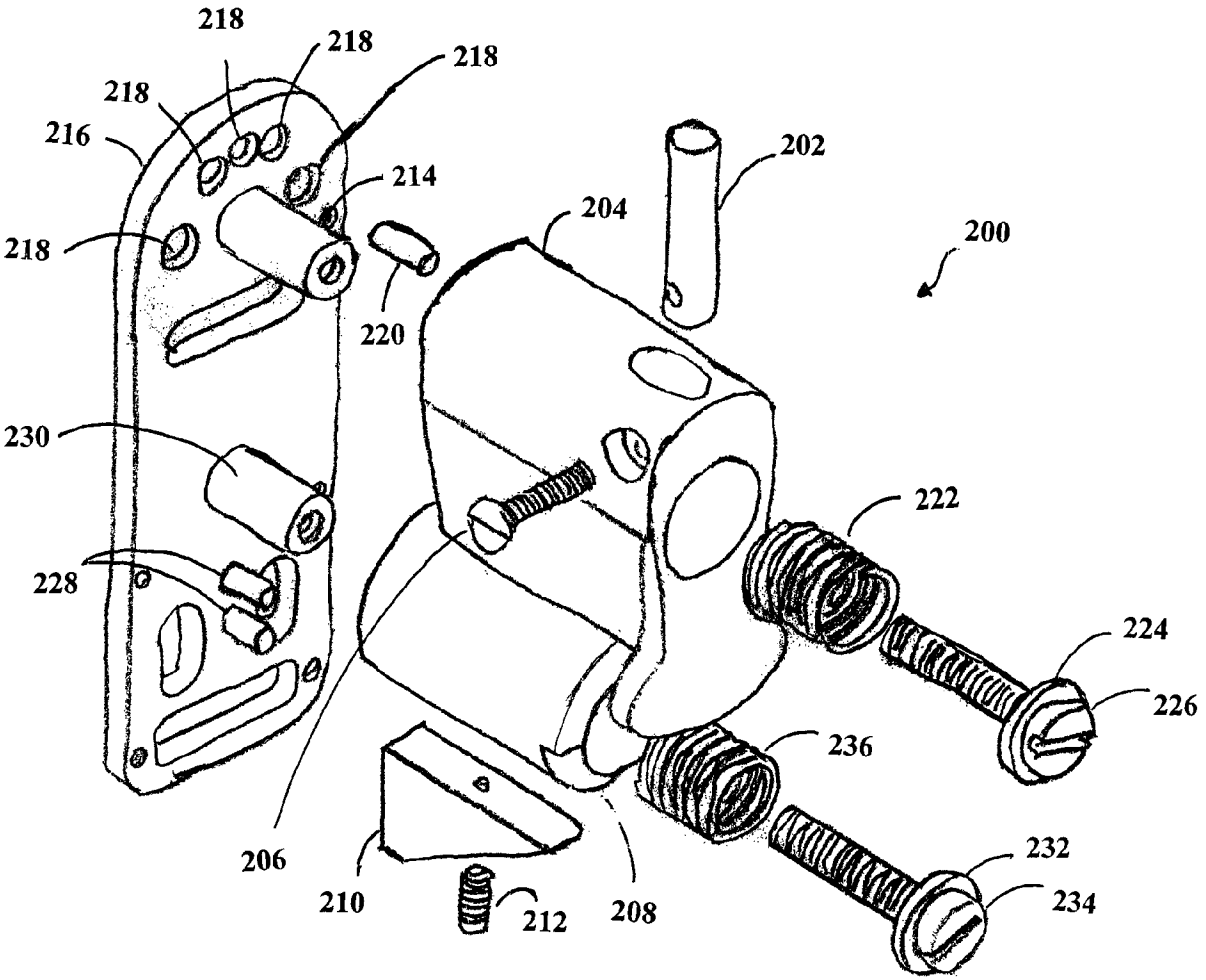
FIG. 14 illustrates an exploded view of another embodiment of the sling clip.

FIG. 14 illustrates an exploded view of another embodiment of the sling clip that operates in substantially the same manner as the sling clip 126 described above in connection with FIGS. 7-13. The sling clip 200 of FIG. 14 includes a lever 202 that is movable between a locked position, a spool position, and an open position. The lever 202 is connected to a pivot barrel 204 by a machine screw 206. The pivot barrel 204 pivots about a pivot pin 214 between a locked position, a spool position, and an open position in response to movements of the lever 202. FIG. 14 illustrates the lever 202 in the locked position, in which the strap 20 is clamped into position and prevented from freely sliding between the pivot barrel 204 and a cam 208, which is held in place by a diagonal bracket 210 secured by diagonal bracket pins 228 and a set screw 212. The diagonal bracket 210 may be angled to prevent the strap 20 from snagging as the rifle is raised into position.

In the locked position, the pivot barrel 204 compresses the strap 20 into the cam 208, which is supported by a cam pin 230 and is rotatably secured by a washer 232 and a machine screw 234. A spring 236 provides tension to further secure the cam 208, while allowing the cam 208 to be released quickly. The pivot barrel 204 and the cam 208 are supported by a base plate 216 that has holes 218 formed in it to correspond to the locked, spool, and open positions. When the lever 202 is actuated by pressing the lever 202 outward and turning the lever 202, a locating pin 220 is removed from the hole 218 corresponding to the locked position, and the pivot barrel 204 can be moved to the spool position or the open position. When the pivot barrel 204 is moved to the desired position, the user releases the lever 202, and the locating pin 220 is inserted into the hole 218 corresponding to the spool position or the open position by action of a spring 222, which is held in place by a washer 224 and a machine screw 226.

Figure 15:
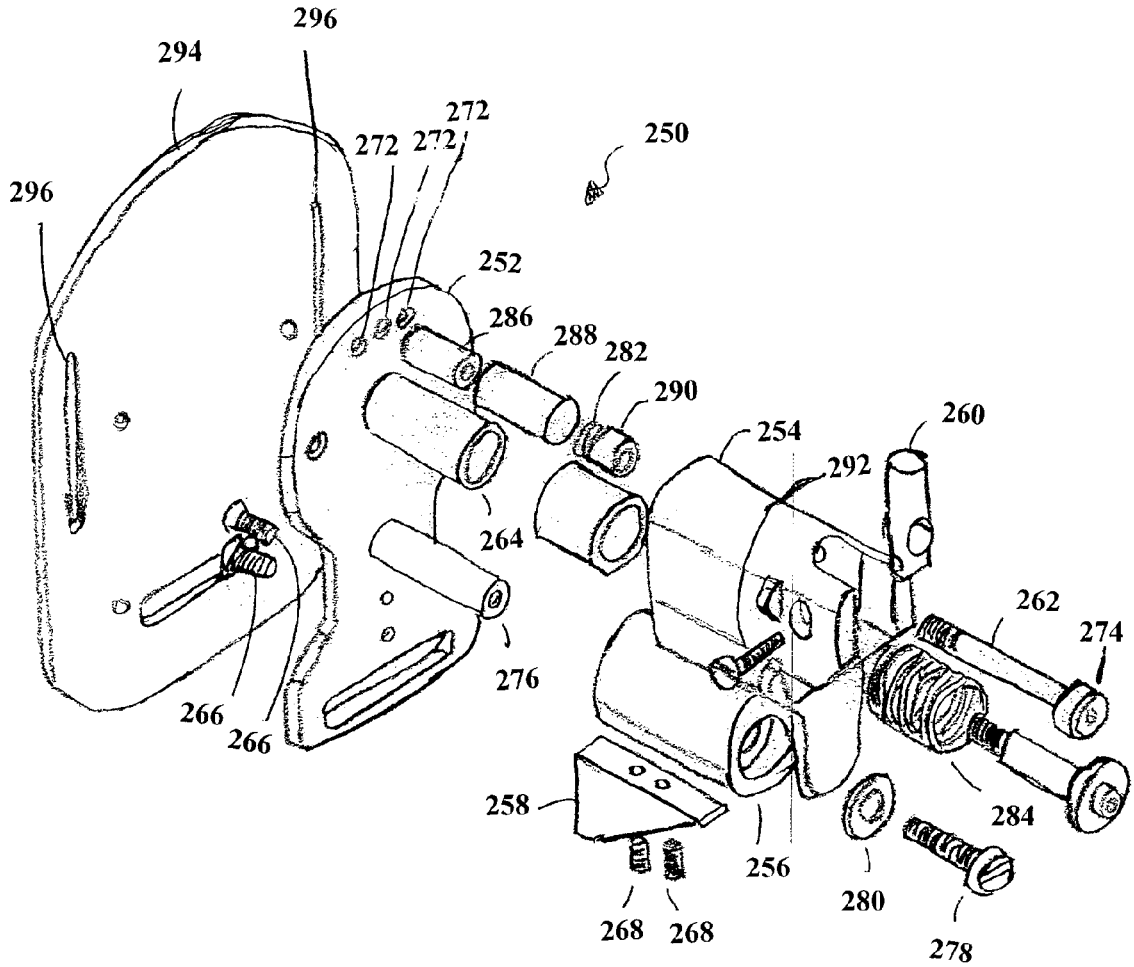
FIG. 15 illustrates an exploded view of another sling clip according to another embodiment.
Figure 16:
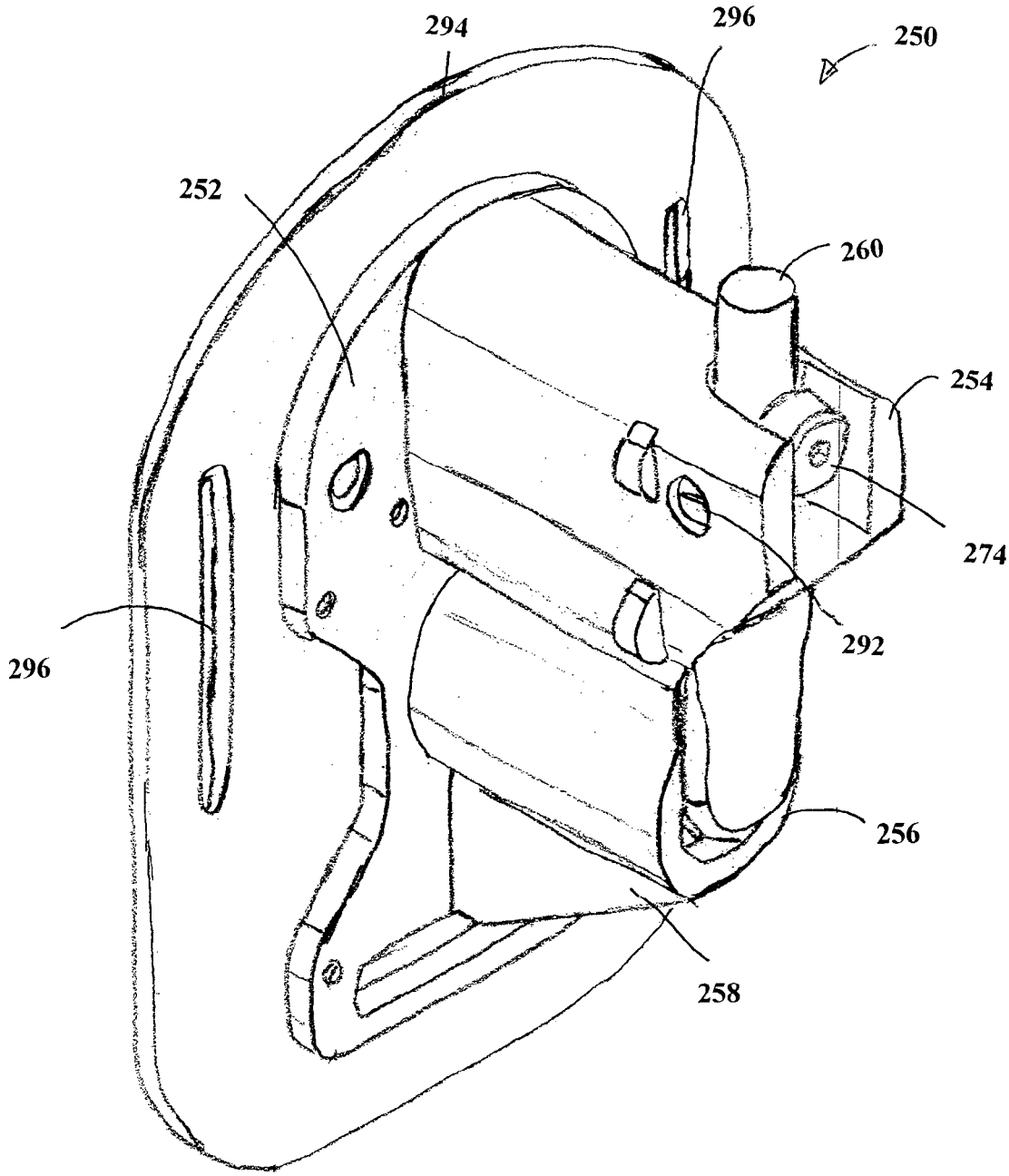
FIG. 16 illustrates the sling clip of FIG. 15 in an assembled form.
Figure 17:
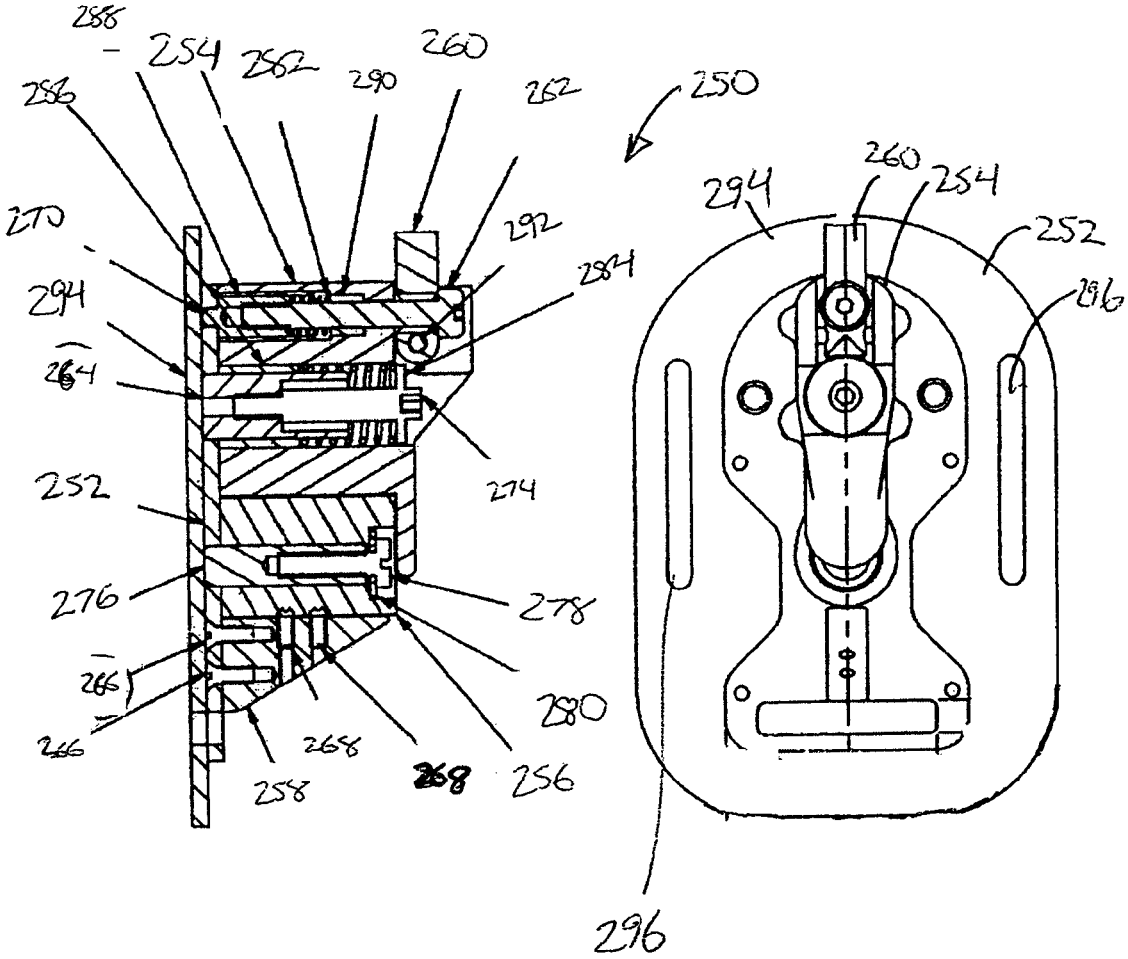
FIG. 17 illustrates a cutaway view of the sling clip of FIG. 15.

FIG. 15 illustrates an exploded view of another sling clip 250 according to another embodiment. FIG. 16 illustrates the sling clip 250 in its assembled form. FIG. 17 illustrates a cutaway view of the sling clip 250. A base plate 252 formed from, for example, stainless steel, serves as a mounting bracket for a cam assembly that includes a pivot barrel 254, an eccentric cam 256, and a diagonal bracket 258. A backing pad 294 is mounted on the back of the base plate 252 to help dissipate blows that impinge upon the sling clip 250 so as to reduce the potential for injury to the bearer B. The backing pad 294 may have slots 296 to accommodate a belt. The backing pad 294 may be formed, for example, from nylon, which is relatively lightweight and durable and can be cut relatively easily. In some embodiments, the base plate 252 may be mounted to the backing pad 294 so as to be capable of being folded substantially flat with respect to the backing pad 294 when the sling clip 250 is not in use.

A lever 260 is movable between an open position, a spool position, and a locked position. The lever 260 is connected to the pivot barrel 254 by a bolt 262, which is guided and protected by bushings 286, 288, and 290. A pin 292 traverses the lever 260 and the pivot barrel 254 and screws into the pivot barrel 254 to further secure the lever 260 to the pivot barrel 254. The pivot barrel 254 pivots about a pivot pin 264, which is tig welded to the base plate 252, between a locked position, a spool position, and an open position in response to movements of the lever 260. The pivot pin 264 is drilled to accept a shoulder bolt 274, which holds the pivot barrel 254 in place.

FIG. 16 illustrates the lever 260 in the locked position, in which the cam 256 clamps the strap 20 into position and prevents the strap 20 from freely sliding between the pivot barrel 254 and the cam 256. The diagonal bracket 258 holds the cam 256 in place and is secured by machine screws 266 and set screws 268. The diagonal bracket 258 may be angled to prevent the strap 20 from snagging as the rifle is raised into position. The cam 256 is also held in place by a cam pin 276, which is tig welded to the base plate 252 and is drilled to accept a machine screw 278, which along with a washer 280 holds the cam 256 in place. In some embodiments, a shoulder bolt or other fastener can be used in place of the machine screw 278. The positioning of the cam 256 can be adjusted incrementally using the set screws 268 to adapt to straps of various thicknesses and to vary the amount of tension used to secure the rifle. In addition, the cam 256 can be set to allow for upper body exercise, which can help develop specific muscles for shooting.

The base plate 252 has a number of chamfered drill holes 272, each of which corresponds to one of the operating positions of the sling clip 250—open, spool, or locked. In the open position, the strap 20 can be loaded. In the spool position, the strap 20 can be moved freely, and the sling clip 250 provides tension. The spool position allows the rifle to be moved freely.

In the locked position, the strap 20 is compressed between the pivot barrel 254 and the cam 256 and is prevented from moving.

When the lever 260 is actuated by pressing the lever 260 and turning it, a locating pin 270 disposed at the end of the bolt 262 is retracted from the hole 272 in which it is currently located. The lever 260 is then rotated to the open, spool, or locked position and is released. When the lever 260 is released, the locating pin 270 is inserted into the hole 272 corresponding to the desired position by action of a spring 282. The spring 282 retains the locating pin 270 in place until the lever 260 is again actuated. In addition, the pivot barrel 254 is deeply drilled to allow a spring 284 to move for quick release action. The spring 284 provides tension to retain the pivot barrel 254 against the base plate 252, while allowing the pivot barrel 254 to move away from the base plate 252 when the spring 284 is compressed, e.g., when the strap 20 is pulled away from the body of the bearer B.

In the open position, the strap 20 can be loaded into the sling clip 250. The sling clip 250 can be used to stabilize a shot in the open position by maintaining upward tension on the strap 20. When the rifle is lowered, the strap 20 will fall out of the sling clip 250.

The spool position can be attained by pushing the lever 260 outward and rotating it counterclockwise until the locating pin 270 drops into the hole 272 corresponding to the spool position. In the spool position, the sling clip 250 contains the strap 20 until it is released by turning the lever 260 back to the open position. The sling clip 250 will also release the strap 20 if forced by the quick release action of the spring loaded pivot barrel 254.

Figure 18:
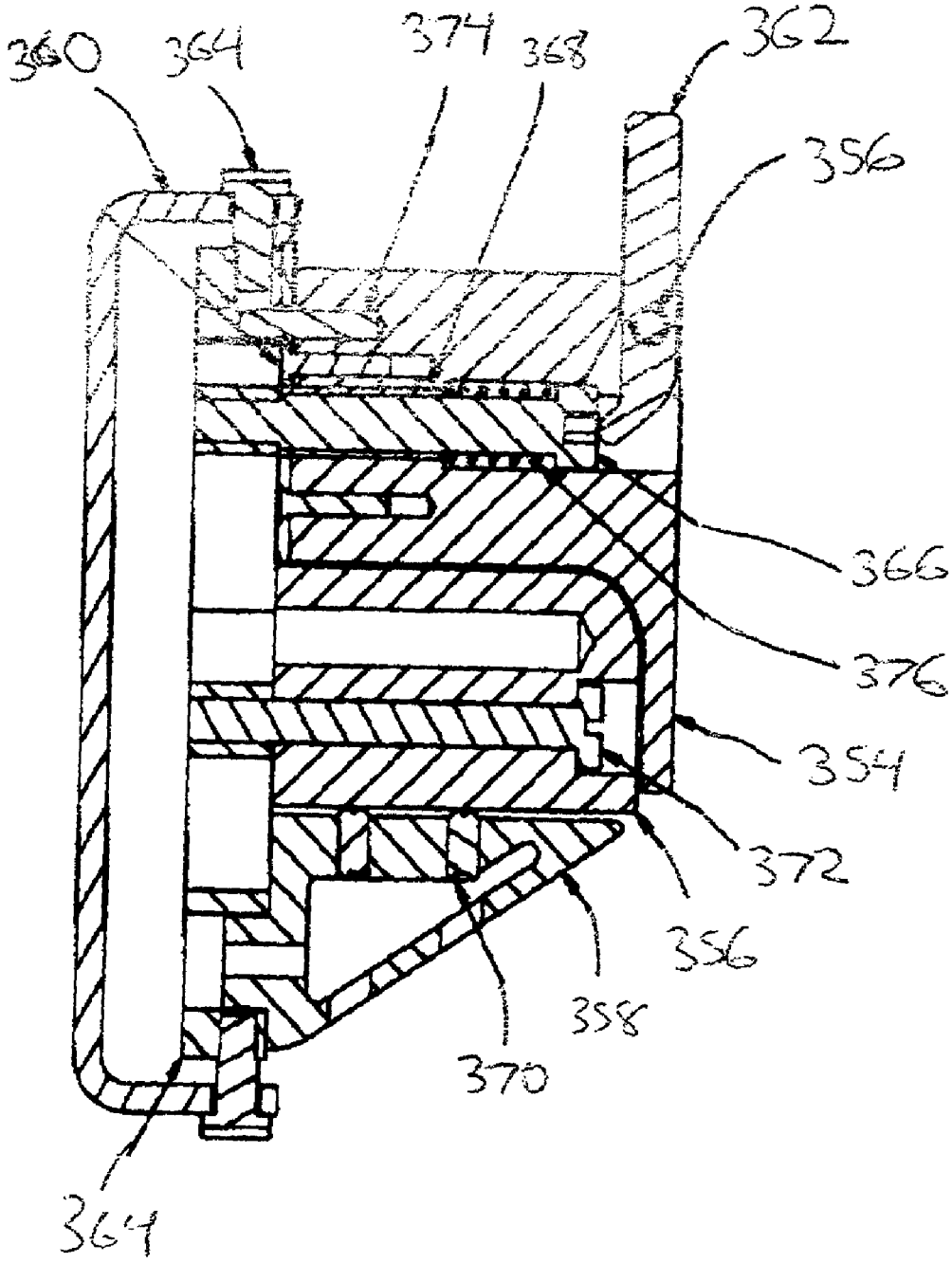
FIG. 18 illustrates a cutaway view of yet another embodiment of the sling clip.

FIG. 18 shows a cutaway view of another sling clip 350 according to another embodiment. A base plate 352 formed from, for example, stainless steel, serves as a mounting bracket for a cam assembly that includes a pivot barrel 354, an eccentric cam 356, and a diagonal bracket 358. A mounting plate 360 is mounted on the back of the base plate 352. The mounting plate 360 may have slots (not shown) to accommodate a belt. In some embodiments, the base plate 352 may be mounted to the mounting plate 360 by shoulder bolts 364 so as to be capable of being folded substantially flat with respect to the mounting plate 360 when the sling clip 350 is not in use.

A lever 362 is movable between an open position, a spool position, and a locked position. A machine screw 364 traverses the lever 362 and the pivot barrel 354 and screws into the pivot barrel 354 to secure the lever 362 to the pivot barrel 354. The pivot barrel 354 pivots about a shoulder bolt 366, which holds the pivot barrel 354 in place and is guided and protected by a bushing 368, between a locked position, a spool position, and an open position in response to movements of the lever 362.

In the locked position, the cam 356 clamps the strap 20 into position and prevents the strap 20 from freely sliding between the pivot barrel 354 and the cam 356. The diagonal bracket 358 holds the cam 356 in place and is welded to the base plate 352. Set screws 370 can be used to incrementally adjust the positioning of the cam 356 to adapt to straps of various thicknesses and to vary the amount of tension used to secure the rifle. The diagonal bracket 358 may be angled to prevent the strap 20 from snagging as the rifle is raised into position. The cam 356 is held in place by a machine screw 372. In some embodiments, a shoulder bolt or other fastener can be used in place of the machine screw 372. In addition, the cam 356 can be set to allow for upper body exercise, which can help develop specific muscles for shooting.

The base plate 352 has a number of chamfered drill holes, each of which corresponds to one of the operating positions of the sling clip 350—open, spool, or locked. In the open position, the strap 20 can be loaded. In the spool position, the strap 20 can be moved freely, and the sling clip 350 provides tension. The spool position allows the rifle to be moved freely. In the locked position, the strap 20 is compressed between the pivot barrel 354 and the cam 356 and is prevented from moving.

When the lever 362 is actuated by pressing the lever 362 and turning it, a locating pin 374 is retracted from the hole in which it is currently located by action of a spring 376. The lever 362 is then rotated to the open, spool, or locked position and is released. When the lever 362 is released, the locating pin 374 is inserted into the hole corresponding to the desired position by action of the spring 376. The spring 376 retains the locating pin 374 in place until the lever 362 is again actuated.

FIGS. 19 through 25 show the weapon sling and sling clip as they may be used in various positions and configurations. In the position shown in FIG. 19, for example, a rifle 300 is shown in a raised position. The rifle 300 is attached to a sling 302 by a pair of snap hooks 304 located proximate a muzzle end 306 of the rifle 300 and by another snap hook (obscured in FIG. 19) proximate a butt end of the rifle 300 (obscured in FIG. 19). The sling 302 has a relatively inelastic portion whose length can be adjusted using sliders 308. The length may be adjusted to the user's line of sight ahead of time. When the rifle is raised, the sling 302 is automatically tensioned to allow the user to reduce muzzle wobble and to acquire a sight picture rapidly by quickly aligning the sight, shoulder, and eye. The amount of tension in the sling 302 can be controlled via the slider 308 to optimize the user's experience, e.g., to take advantage of the user's "sweet spot." The length of the sling 302 may not need to be adjusted between certain positions, e.g., between standing, kneeling, and sitting positions. Some adjustment may be needed, for example, when transitioning to or from a prone position. When the user is in the prone position, the sling may need to be lengthened by moving the slider 308 forward. In some embodiments, the sling 302 may be marked for the appropriate slider positions for each position of the user.

The sling 302 passes through a sling clip 3 10, which may be implemented as any of the embodiments described above in connection with FIGS. 1-18, and which is contained in a pouch 312 that is located on a belt 314 worn by the user. The sling clip 310 is also connected to a leg strap assembly 316 that provides tension for greater stability. With the leg strap assembly 316 attached to a leg of the user, the user's leg muscles can assist in the task of drawing the butt of the rifle tight to the user's shoulder, and the tension of the sling 302 can be increased by straightening the leg.

Figure 19:
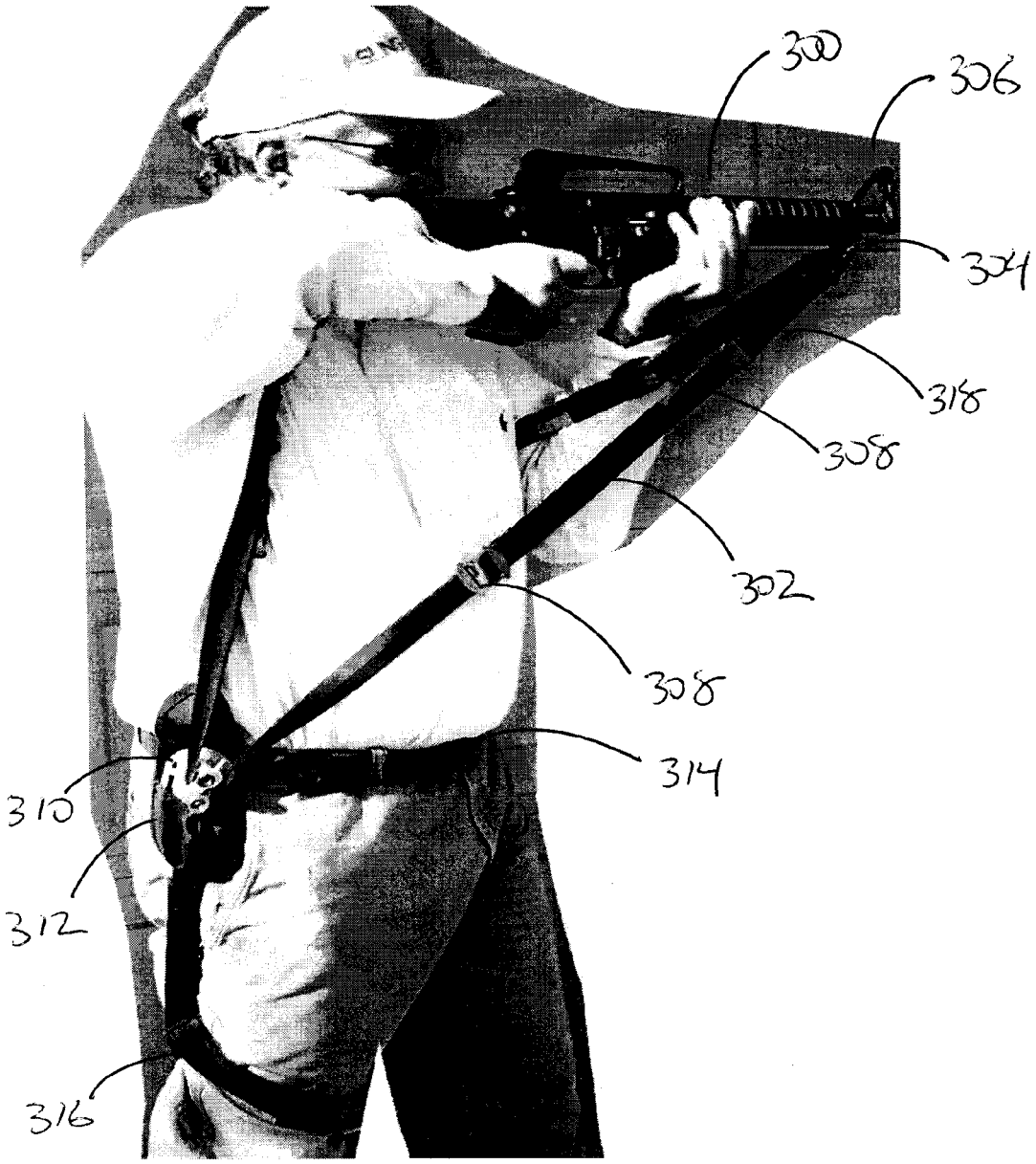
FIG. 19 illustrates a sling system in use with a rifle in a raised position.
Figure 20:
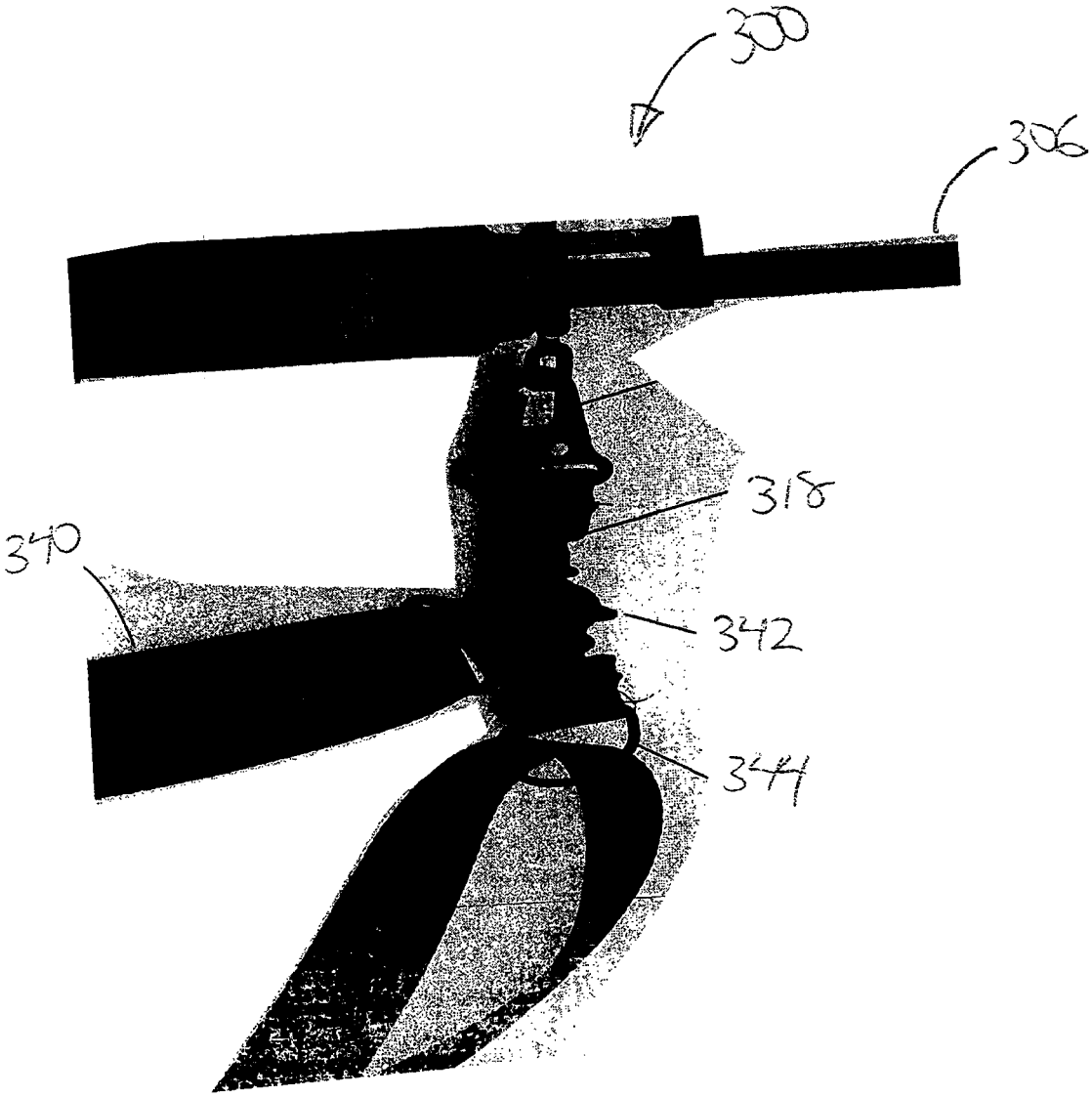
FIG. 20 illustrates a portion of the configuration of FIG. 19.

FIG. 20 illustrates a portion of the configuration of FIG. 19, in particular, the portion located proximate the muzzle end 306 of the rifle 300. The sling 302 has a relatively elastic portion 318 that is encased in a tubular nylon encasing. The elastic portion 318 provides shock absorption and facilitates rapid sight realignment for wobble. In addition, the elastic portion 318 allows some length adjustment when the sling 302 is locked in place by the sling clip 3 10. The elastic portion 318 is connected to a back strap portion 340 of the sling 302 by an oval loop 342 that engages a snap hook for additional lateral stability. A D-ring 344 also attaches to the elastic portion 318 and facilitates movement of the sling 302.

Figure 21:
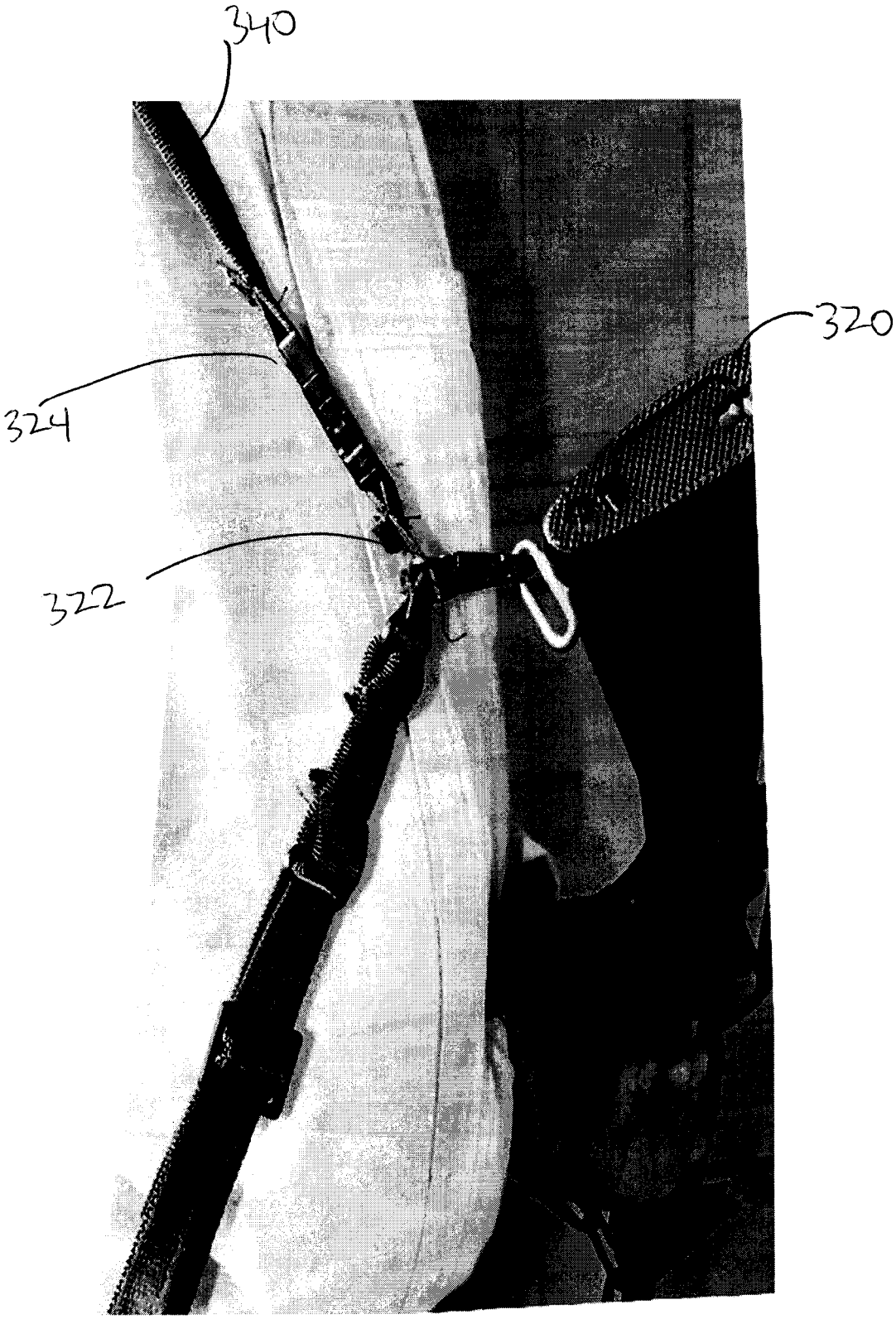
FIG. 21 illustrates another portion of the configuration of FIG. 19.

FIG. 21 illustrates a portion of the configuration of FIG. 19 for a right-handed user. As shown in FIG. 21, a butt end 320 of the rifle 300 is coupled to the right shoulder of the user. The sling 302 is attached to the rifle 300 by a snap hook 322 located proximate the butt end 320. The sling 302 has a side release buckle 324 forming part of the back strap portion 340 of the sling 302. The side release buckle 324 can be detached quickly to convert the sling 302 from a three-point sling, retained at the muzzle end 306, the butt end 320, and the sling clip 310, to a two-point sling. The back strap portion 340 of the sling 302 may terminate in a snap hook (not shown in FIG. 21) that engages a D-ring on the belt 314.

Figure 22:
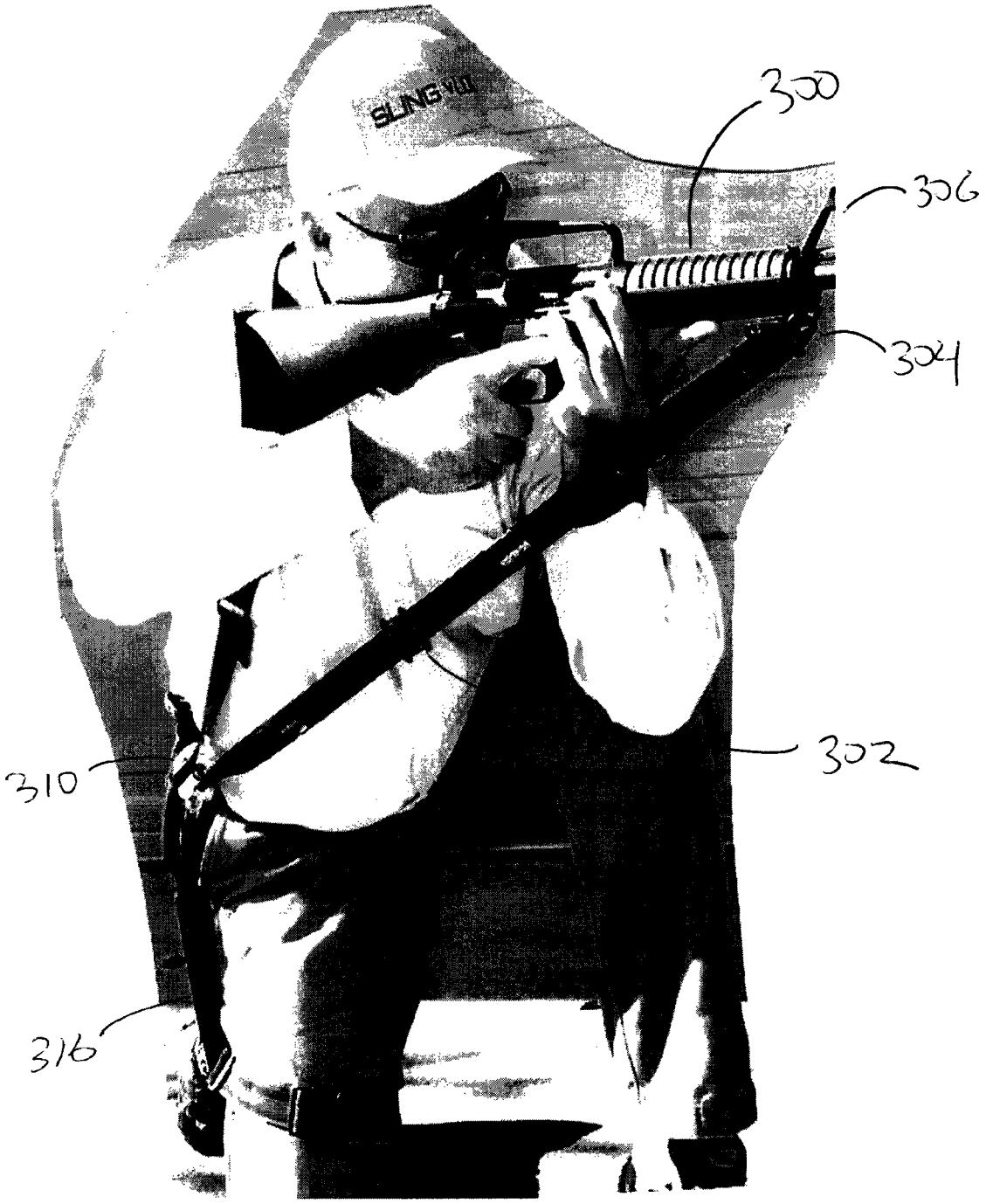
FIG. 22 illustrates a sling system in use with a rifle in another shooting position.

FIG. 22 illustrates the sling 302 as it may be used in another shooting position. As shown in FIG. 22, the sling 302 travels from the butt end 320 of the rifle 300 over the right shoulder of the user, then under the left shoulder of the user. The sling 302 then attaches to the snap hook 304, which is located near the muzzle end 306 of the rifle 300.

Figure 23:
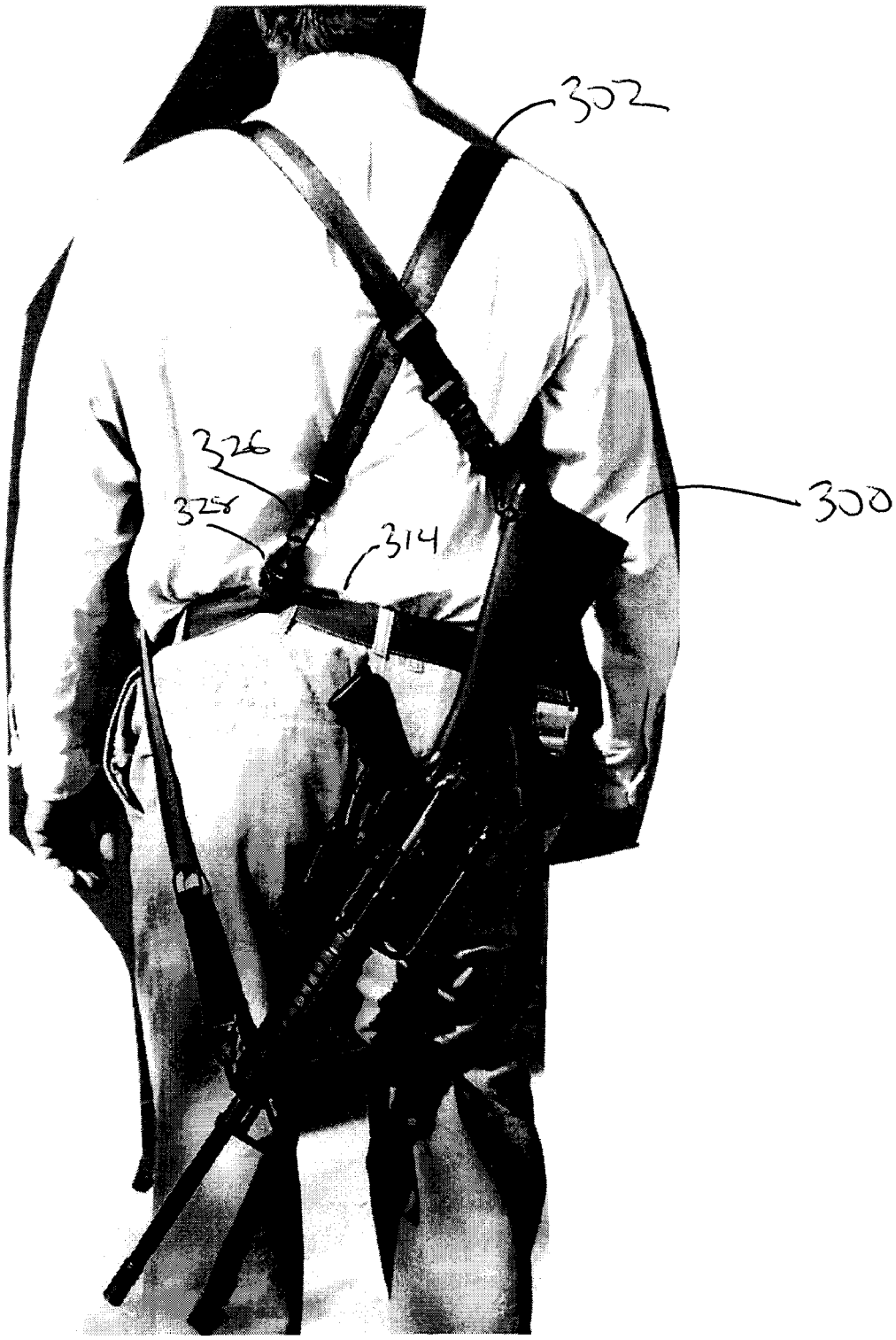
FIG. 23 illustrates a rear view of a sling system in a backpack-style carry configuration.

FIG. 23 illustrates a rear view of the sling 302 used in a backpack-style carry mode. In this mode, a rectangular ring 326 located near a far side of the sling 302 attaches to the belt 314 and captures a snap hook 328. In some other modes, the rectangular ring 326 facilitates conversion of the sling 302 to a two-point configuration and facilitates supporting the rifle 300 in a hands-free mode or when the rifle 300 is hanging from the right shoulder of the user. The sling 302 can be readily reconfigured to a three-point configuration by disengaging the snap hook 328 and attaching the snap hook 328 to the front end of the rifle 300.

Figure 24:
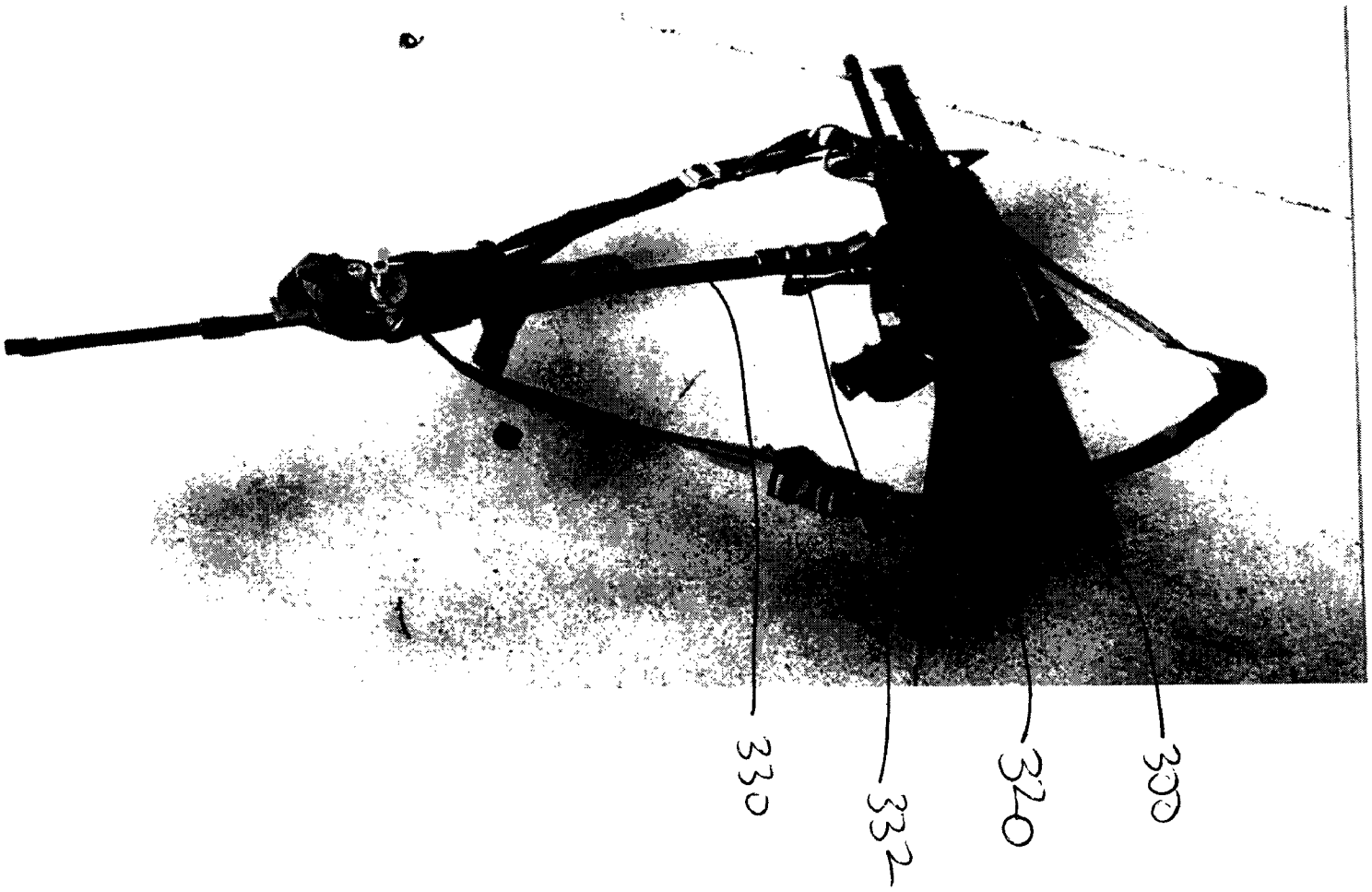
FIG. 24 illustrates a sling system employed in conjunction with a shooting stick.

FIG. 24 illustrates the sling 302 as it may be used in connection with a shooting stick 330. The shooting stick 330 typically has a recessed portion to hold the rifle 300 and a hand grip 332. The shooting stick 330 provides front end balance for the rifle 300 and is commonly used in hunting applications, and less commonly in military applications. The sling 302 can be employed in either a two-point or a three-point configuration with the shooting stick 330. By attaching the sling clip 310 to the shooting stick 330, greater stability can be achieved by improving triangulation of forces. In addition, the sling clip 310 provides a measure of control of the butt end 320 of the rifle 300.

Figure 25:
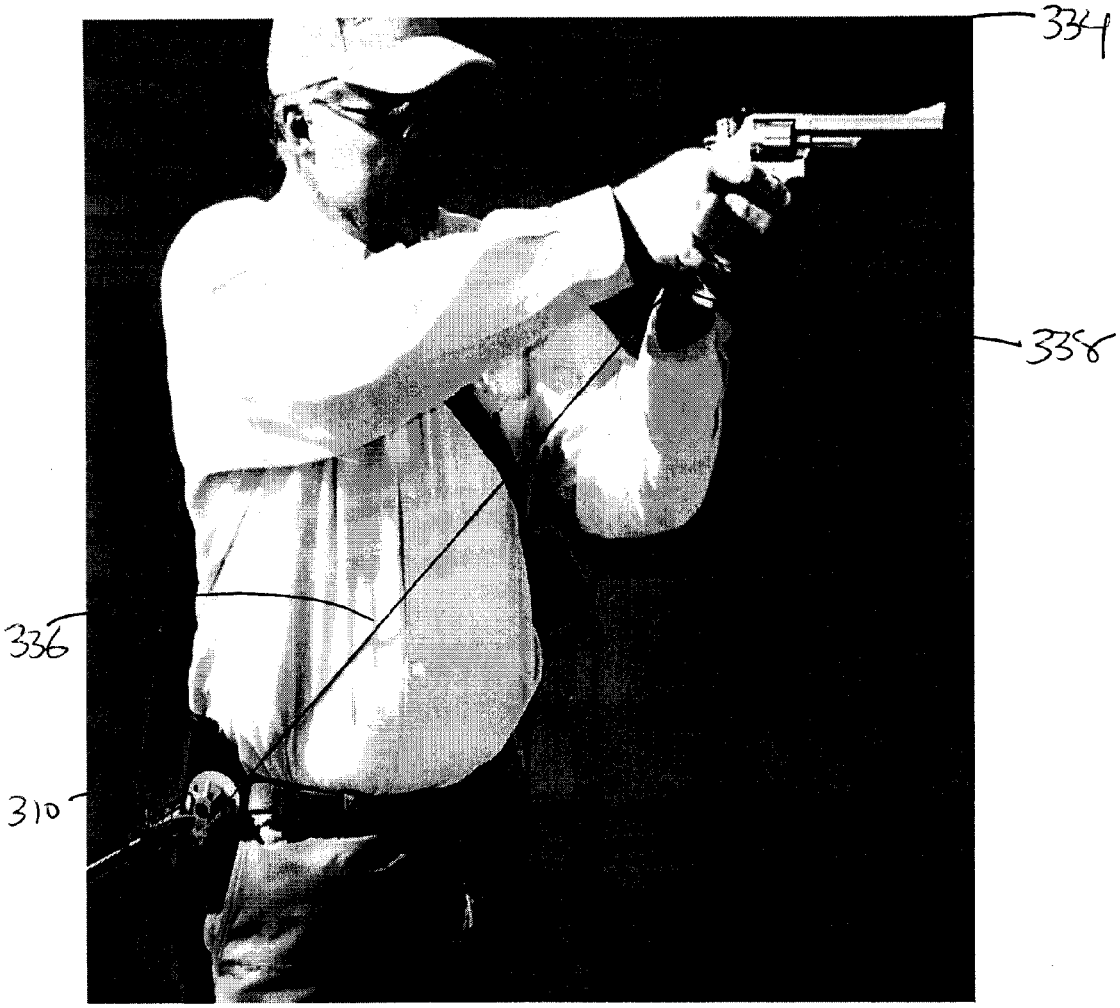
FIG. 25 illustrates a sling system in use with a pistol.

FIG. 25 illustrates the sling clip 310 as it may be used in connection with a pistol 334. As shown in FIG. 25, a sling 336 is connected near a butt end 338 of the pistol 334. The sling 336 passes through the sling clip 310 and may be locked by actuation of the lever as described above.

Figure 26:
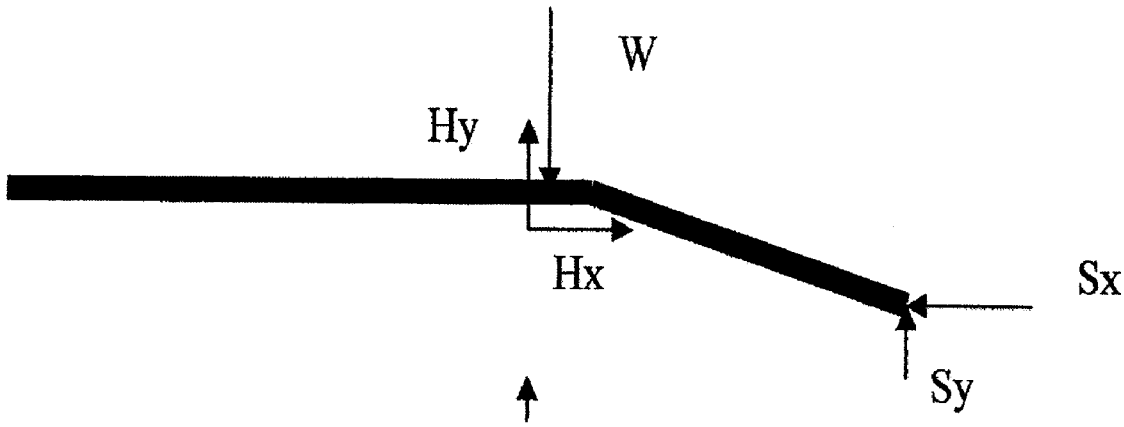
FIG. 26 conceptually illustrates force multipliers in the absence of a sling system.

As described above in connection with FIGS. 1-25, a sling clip and sling that together form a sling lock system can improve biomechanics of shooting a gun. FIG. 26 shows how force multipliers are affected when no sling lock system is used. The weight of the gun is represented by a vector W. The offside/weak arm supports the weight of the gun and pulls the gun against the shoulder, as shown in FIG. 26 as vectors $H_y$ and $H_x$. The vertical and horizontal vector components of the force exerted by the shoulder are indicated by vectors $S_y$ and $S_x$, respectively. The gun has been displaced from the shooter to illustrate the forces more clearly. The vertical force on the gun is primarily created by the strong shoulder muscles (shoulder flexors) while the horizontal force is mostly due to the elbow flexor muscles (biceps and brachialis). When the shooter pulls the gun firmly against the shoulder, the elbow flexors can tire and wobble.

Figure 27:
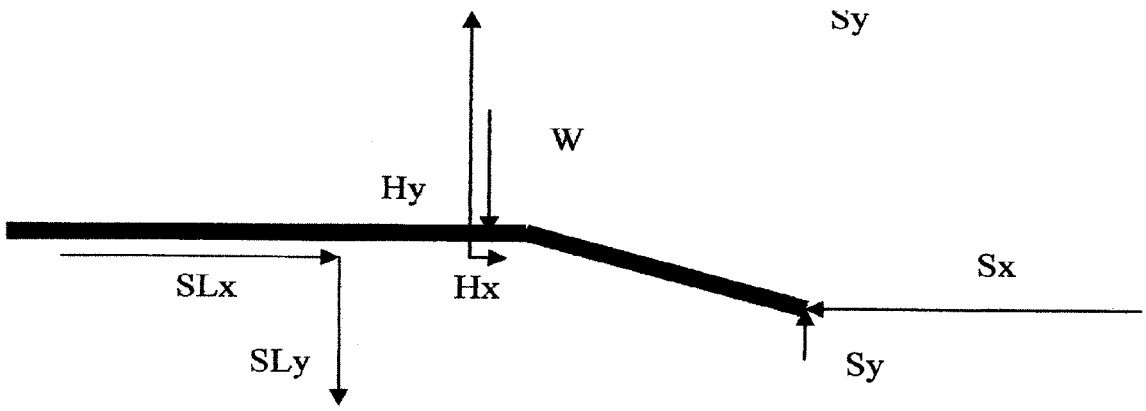
FIG. 27 conceptually illustrates force multipliers in the presence of a sling system.

FIG. 27 shows the biomechanics of the force multiplier forces when a sling lock system is deployed with the gun. The expected result is to reduce the amount of elbow flexor activity and fatigue. As the gun is raised by the strong shoulder flexors, tension develops in the strap. The force exerted by the strap has a vertical vector component indicated by a vector $SL_x$ and a horizontal vector component indicated by a vector $SL_y$. The horizontal component $SL_x$ of the strap force anchors the rifle against the shoulder, reducing or eliminating the need to recruit the elbow flexors. This is expected to reduce the risk of wobble due to weak or fatigued elbow flexors. The strap does, however, pull down on the rifle. As a result, the shoulder flexors must work harder, supporting the weight of the rifle and countering the downward component of the strap force. Fortunately, the shoulder flexors are a strong muscle group.

Figure 28:
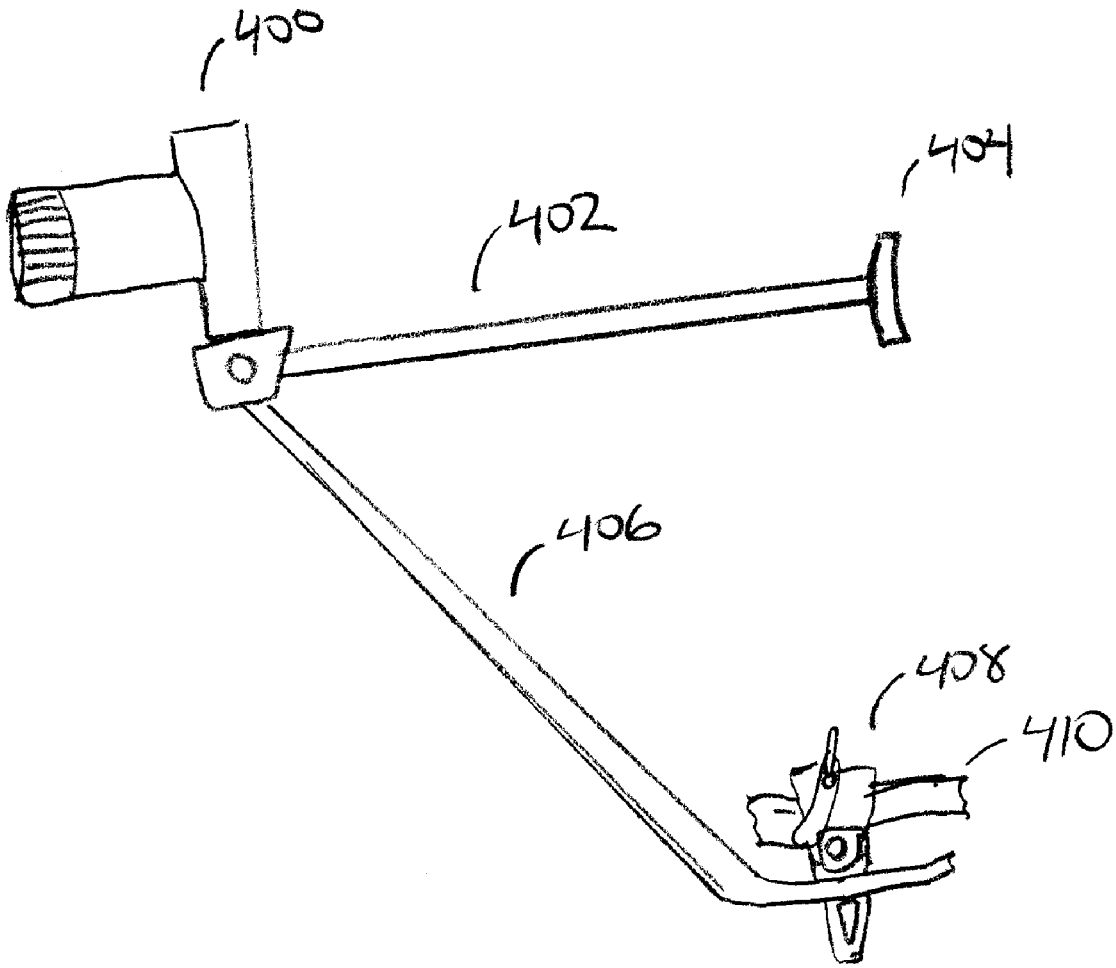
FIG. 28 illustrates a sling system in use with a camera.

Several of the embodiments have been described above as being usable with rifles. As disclosed above, however, the term "weapons" is broadly defined to include shotguns, handguns, bows, crossbows and other weapons as well as hand-held equipment such as binoculars, telescopes, cameras and the like. FIG. 28 illustrates a sling lock system in use with a camera 400 mounted on a stock 402. The stock 402 may be telescoping or nontelescoping and terminates in a shoulder pad 404 that can be drawn tight to a photographer's shoulder, somewhat like the butt end of the rifle described above. A sling strap 406 passes through a sling clip 408, which may be implemented as any of the embodiments described above. The sling clip 408 is secured to a belt 410, which is worn around the waist of a user (not shown in FIG. 28).

The sling clip 408 can be used to enhance the stability of the camera 400 relative to holding the camera 400 in the photographer's hands. This enhanced stability is particularly advantageous in the case of heavy cameras, especially in situations in which the photographic subject is located far from the photographer. In such situations, it can be difficult to frame the subject, particularly if the subject is moving. Stabilizing the camera 400 with the sling lock system facilitates framing the subject by reducing unintentional movements of the camera 400.

Figure 29:
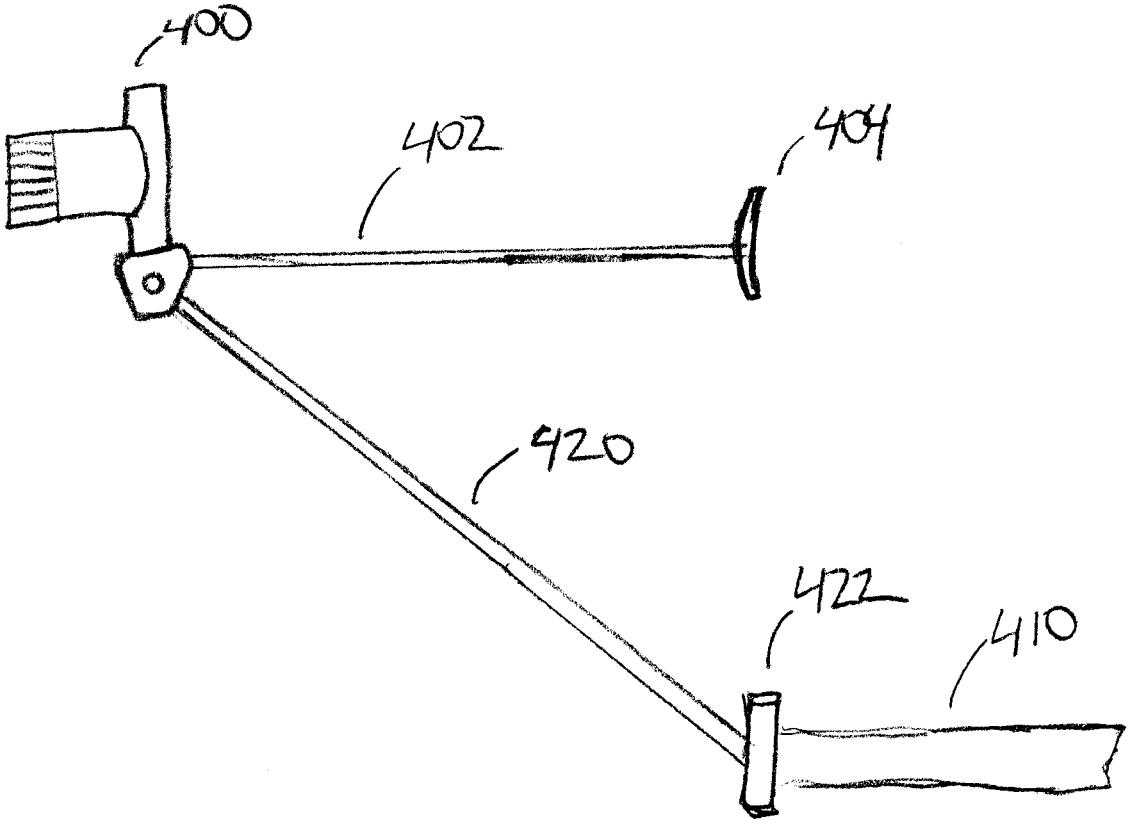
FIG. 29 illustrates a modular camera support system.

FIG. 29 illustrates an alternative embodiment in which the sling strap 406 of FIG. 28 is replaced by a monopod 420, which may be telescoping or nontelescoping. The monopod 420 is retained in a flag holder 422, which is secured to the belt 410. While not shown, additional members may extend from the camera 400 toward the ground or another supporting surface, such that the camera 400 is supported by a bipod or tripod configuration.

It is to be understood that even though numerous characteristics and advantages of various embodiments have been set forth in the description, together with details of the structure and function of various embodiments, this disclosure is illustrative only, and changes may be made in detail, especially in matters of structure and arrangement of parts within the principles described herein to the full extent indicated by the broad general meaning of the terms in which the appended claims are expressed. For example, the particular elements may vary depending on the particular application for the sling while maintaining substantially the same functionality without departing from the scope and spirit of the disclosure. Further, the foregoing description of various embodiments implemented in connection with rifles is to be construed by way of illustration rather than limitation. The embodiments disclosed herein may provide certain advantages, such as increased stability, for other types of weapons, such as pistols, shoulder-mounted rocket launchers, such as light anti-tank weapons (LAWs), as well as recreational weapon analogs such as paintball guns and other pneumatically powered projectile devices. Further, while various embodiments are described as being implemented to increase the stability of a weapon, it will be appreciated that the principles of the disclosure are applicable to stability systems operable in other applications, such as cameras, binoculars, and the like.

What is claimed is:

1. A sling system for stabilizing, in use, a device benefitting from accurate orientation by a user of the device, the sling system comprising:

a flexible strap having first and second end portions configured to be secured near respective first and second locations of the device; and a sling retainer defining an opening configured to releasably secure the strap proximate the user's body when the strap is received through the opening when the device is in its position of use;

wherein the sling retainer comprises a clamping mechanism operatively configured to secure the strap within the sling retainer when the device is in a position of use; wherein the clamping mechanism comprises: a cam; and a pivot barrel spring-loaded so as to be configurable between an open position, a spool position, and a locked position, the pivot barrel arranged to compress the strap between the pivot barrel and the cam when the pivot barrel is configured in the locked position.

2. The sling system of claim 1, wherein the first location of the device is located near an inner end portion of the device and the second location of the device is located near an outer end portion of the device.

3. The sling system of claim 1, wherein the clamping mechanism is operatively configured to loosely hold the strap within the sling retainer when the device is not in the position of use so that the user can move the device from a slung position to the position of use without disconnecting the strap from the sling retainer.

4. The sling system of claim 1, wherein the clamping mechanism further comprises a set screw arrangement for adjusting a position of the cam.

5. The sling system of claim 1, wherein the strap is relatively inelastic.

6. The sling system of claim 1, wherein the strap is relatively elastic.

7. The sling system of claim 1, wherein the strap comprises a relatively inelastic portion and a relatively elastic portion.

8. The sling system of claim 1, wherein the device comprises a stock and a camera mounted on the stock.

9. The sling system of claim 1, wherein the device is a pair of binoculars.

10. The sling system of claim 1, wherein the device is a weapon.

11. The sling system of claim 10, wherein the strap and the sling retainer are constructed and arranged to allow the user of the weapon to carry the weapon in a port arms position, cradled in a crook of an arm of the user, to be slung over a shoulder of the user, to be slung across a back of the user, and to be carried in a hand of the user with an arm of the user extended, respectively.

12. The sling system of claim 10, wherein the strap is constructed and arranged to permit the weapon to be fired from a group of firing positions consisting of a prone position, a sitting position, a squatting position, an offhand position, a standing position, a kneeling position, and a rest position in which the weapon is supported, at least in part, by an object that is not the user of the weapon.

* * * * *